US006761015B2

(12) United States Patent
Murphy et al.

(10) Patent No.: US 6,761,015 B2
(45) Date of Patent: Jul. 13, 2004

(54) MECHANISM FOR INSERTING A STRAW INTO A CONTAINER AND METHOD THEREFORE

(75) Inventors: Peter F. Murphy, Grosse Pointe Farms, MI (US); James H. Kurtz, Jr., Grosse Pointe Farms, MI (US); Clifford Marritt, Lynchburg, VA (US)

(73) Assignee: The KeyStraw Company, LLC, Sterling Heights, MI (US)

( * ) Notice: Subject to any disclaimer, the term of this patent is extended or adjusted under 35 U.S.C. 154(b) by 0 days.

(21) Appl. No.: 09/758,938

(22) Filed: Jan. 11, 2001

(65) Prior Publication Data

US 2001/0002532 A1 Jun. 7, 2001

Related U.S. Application Data

(63) Continuation-in-part of application No. 09/429,115, filed on Oct. 27, 1999.

(51) Int. Cl.[7] ..... B65B 61/20

(52) U.S. Cl. ..... 53/445; 53/474; 53/473; 53/551

(58) Field of Search ..... 53/445, 474, 473, 53/238, 300, 551, 236, 239

(56) References Cited

U.S. PATENT DOCUMENTS

| | | | |
|---|---|---|---|
| 2,279,396 | A | 4/1942 | Hanson, Jr. |
| 3,019,575 | A | 2/1962 | Charley et al. |
| 3,656,654 | A | 4/1972 | Brinkley, III |
| 4,614,074 | A | 9/1986 | Evers |
| 4,728,001 | A | 3/1988 | Serba |
| 4,826,034 | A | 5/1989 | Forbes |
| 4,923,083 | A | 5/1990 | Forbes |
| 4,923,084 | A | 5/1990 | Forbes |
| 4,969,308 | A | 11/1990 | Hakansson |
| 5,148,971 | A | 9/1992 | Ahn |
| 5,305,582 | A | 4/1994 | Abbott |
| 5,431,297 | A | 7/1995 | Rosello |
| 5,482,202 | A | 1/1996 | Wen |
| 5,518,143 | A | 5/1996 | Iodice |
| 5,709,066 | A | 1/1998 | Prochaska et al. |
| 5,758,473 | A | 6/1998 | Patelli |
| 5,960,988 | A | 10/1999 | Freixas |
| 6,041,579 | A | 3/2000 | Savoury et al. |

*Primary Examiner*—Mickey Yu
*Assistant Examiner*—Sameh Tawfik
(74) *Attorney, Agent, or Firm*—Harness, Dickey & Pierce, P.L.C.

(57) ABSTRACT

A high speed straw insertion machine has a device which feeds a straw, feeds a lifter and then engages the straw with the lifter. This assembly is transported to a mechanism which secures the lifter to the straw and then puts the straw and the float into a container. The container with the straw and the float is transported to an anchoring machine which engages the straw and the container to trap the straw and float entirely within the container. In one embodiment, the straw is positioned between a corner and a shoulder defined by the container and is retained in this position due to the flexibility of the straw. In another embodiment, the straw is positioned below a rib formed in the body of the container.

4 Claims, 21 Drawing Sheets

MECHANISM FOR INSERTING A STRAW INTO A CONTAINER AND METHOD THEREFORE

This is a continuation-in-part of application No. 09/429,115 filed Oct. 27, 1999.

FIELD OF THE INVENTION

The present invention relates to a method and apparatus for placing a straw into a container. More specifically, the present invention relates to a method and apparatus for placing a straw into a container which can be incorporated into an automatic fluid filling line for the container.

BACKGROUND OF THE INVENTION

Various designs have been proposed in the prior art for placing a straw within a beverage container. The straw is designed to become accessible to the user when the beverage container is opened. One prior art design relies upon the user to manipulate the container once it is opened to align the straw with the opening. Other prior art designs include a mechanism located within the container which has the ability to position the straw in alignment with the opening. The act of opening the container imparts a force and/or motion to the mechanism which then positions the straw in alignment with the opening. Still other prior art designs releasably trap the straw within the container. Once the container is filled, the straw is released in the container to be located within the closed opening. When the container is opened, it extends out of the container through the opening.

While each of the prior art designs have their advantages and disadvantages, one thing they all have in common is the need to be assembled within the container automatically. Modern beverage filling lines operate automatically and some operate at a relatively high speed in order to mass produce the filled beverage containers. If a beverage container is going to include a straw disposed within the container, the straw delivery system must be able to be easily installed within the container before, during and after filling. Thus, there is a need to develop a mechanism and method for insertion of the straw delivery system automatically such that it can be incorporated into an existing automatic and/or high speed filling line.

SUMMARY OF THE INVENTION

The present invention provides the art with a unique mechanism which is capable of inserting a straw into a beverage container automatically. The mechanism of the present invention can be incorporated into an existing automatic and/or high speed beverage container filling line or the mechanism of the present invention can be a stand alone system which provides containers having straws which are accumulated and then transferred to the filling machine manually or by other methods known well in the art.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
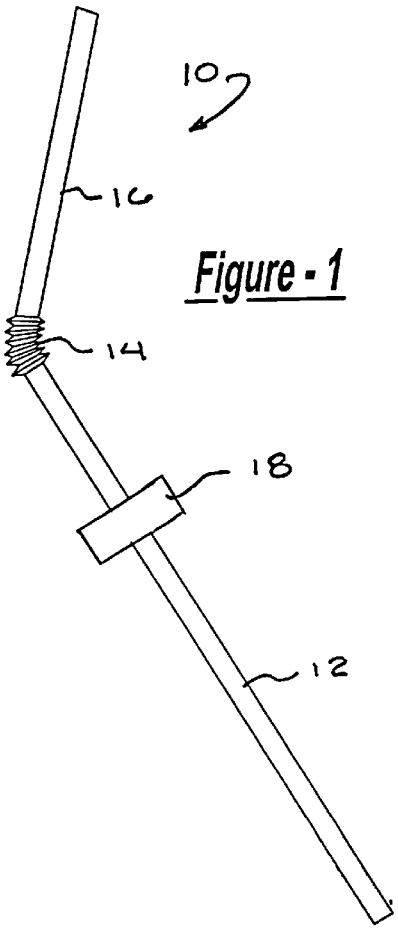
FIG. 1 is a side view of a straw and a lifter which is to be inserted into a container.

Referring now to the drawings in which like reference numerals designate like or corresponding parts throughout the several views, there is shown in FIG. 1 a straw which is designed to be inserted into a container in accordance with the present invention and which is designated by the reference numeral 10. Straw 10 comprises a lower tubular section 12, a pleated section 14 and an upper tubular section 16. A lifter or float 18 is secured to lower tubular section 12. Lifter 18 is secured to straw 10 in order to enhance the buoyancy of straw 10. While lifter 18 is being used to enhance the buoyancy of straw 10, other methods of enhancing buoyancy known in the art can also be used. These methods include but are not limited to coating straw 10 with a buoyant substance, placing lifters other than cylindrical lifter 18 on straw 10 or forming a lifting section integral with straw 10. While FIG. 1 illustrates straw 10 in a bent condition, it is to be understood that the preferred embodiment of the invention inserts straw 10 while it is in a straight position with lower tubular section 12 in alignment with upper tubular section 16.

Figure 2:
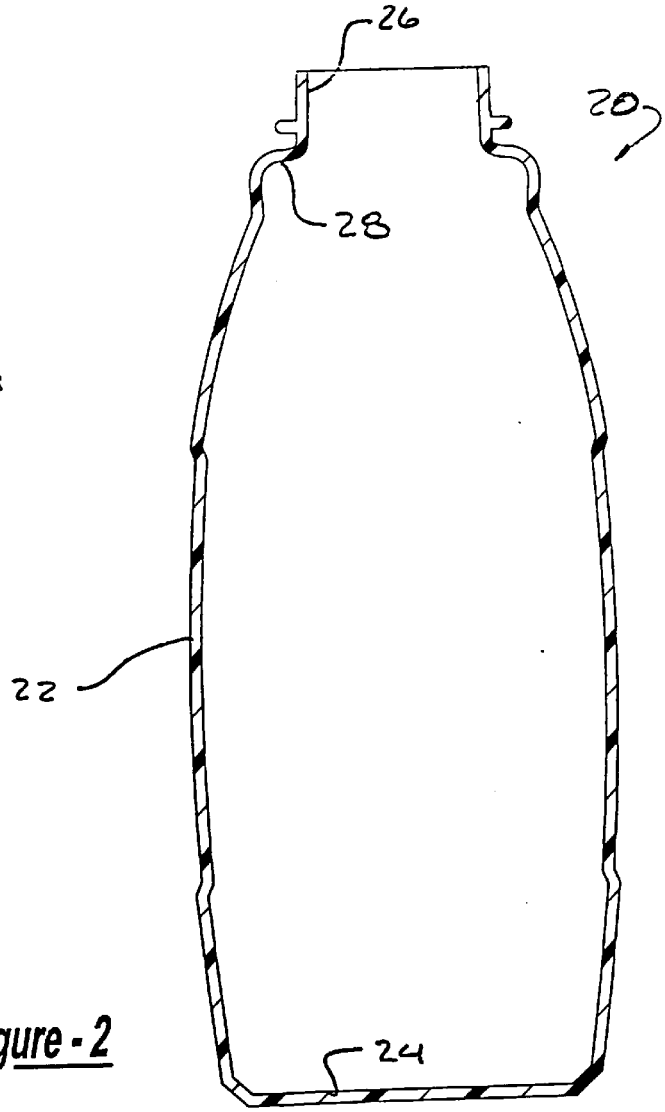
FIG. 2 is a cross-sectional side view of a container into which the straw of FIG. 1 is to be inserted.

Referring now to FIG. 2, a container 20 comprises a generally cylindrical body 22, a closed bottom 24, an open top 26 and a shoulder 28 located adjacent open top 26.

Figure 3:
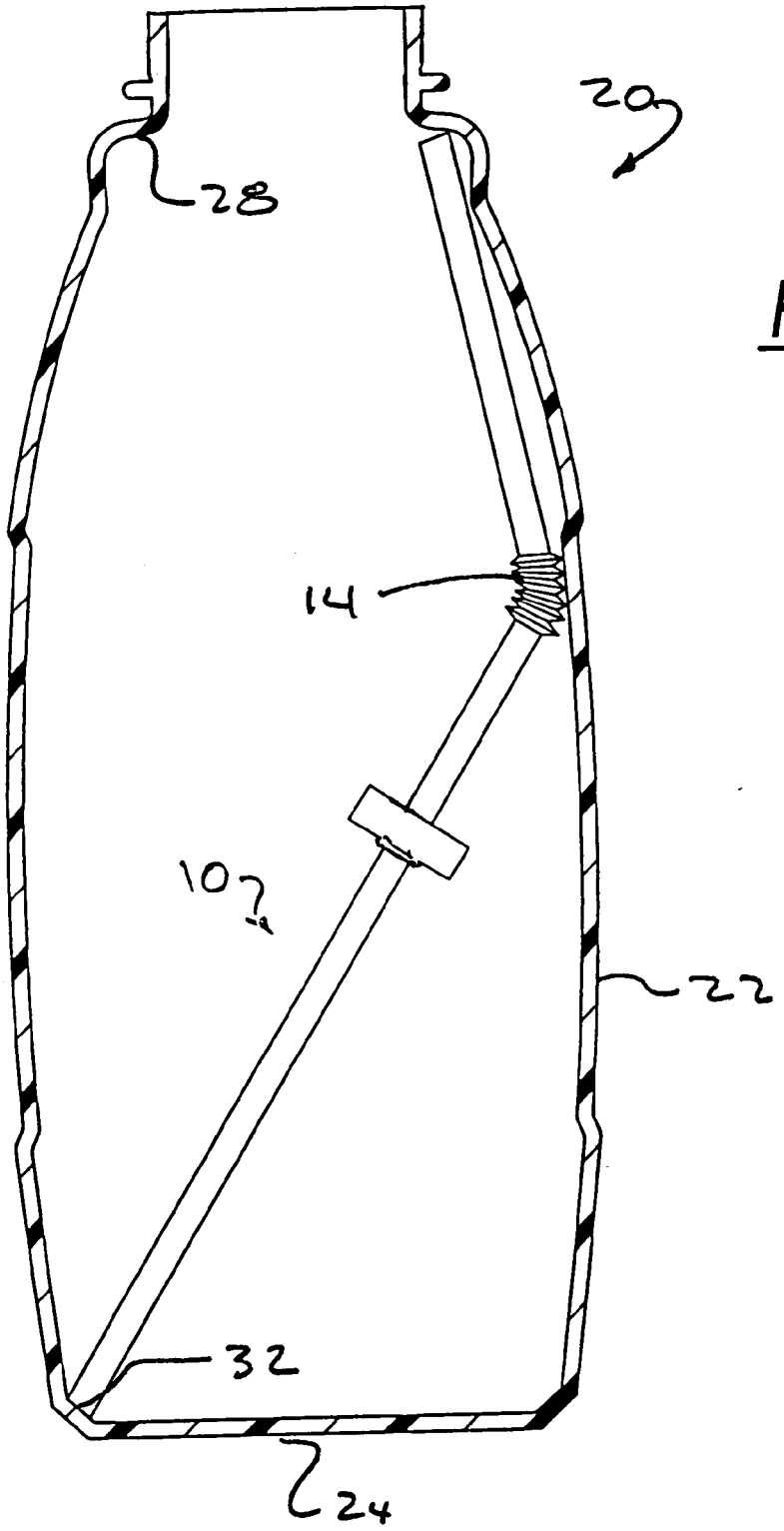
FIG. 3 is a side view, partially in cross-section, of the straw of FIG. 1 assembled into the container of FIG. 2.

Referring now to FIG. 3, straw 10 is shown releasably retained within container 20 which is the position prior to being fed into a high speed filling line for container 20. Straw 10 is retained between a corner 32 defined by body 22 and bottom 24 and shoulder 28. Straw 10 is bent at pleated section 14 and is held in the position shown due to the flexing of pleated section 14. When straw 10 is bent at pleated section 14, the elasticity of the material for straw 10 creates a restoring force which urges straw 10 back into its straight position. This restoring force reacts against corner 32 and shoulder 28 to retain straw 10 within container 20. When straw 10 is to be released, usually after the filling and capping operation, the outer surface of container 20 is flexed inward adjacent shoulder 28 to release straw 10 from shoulder 28.

Figure 4:
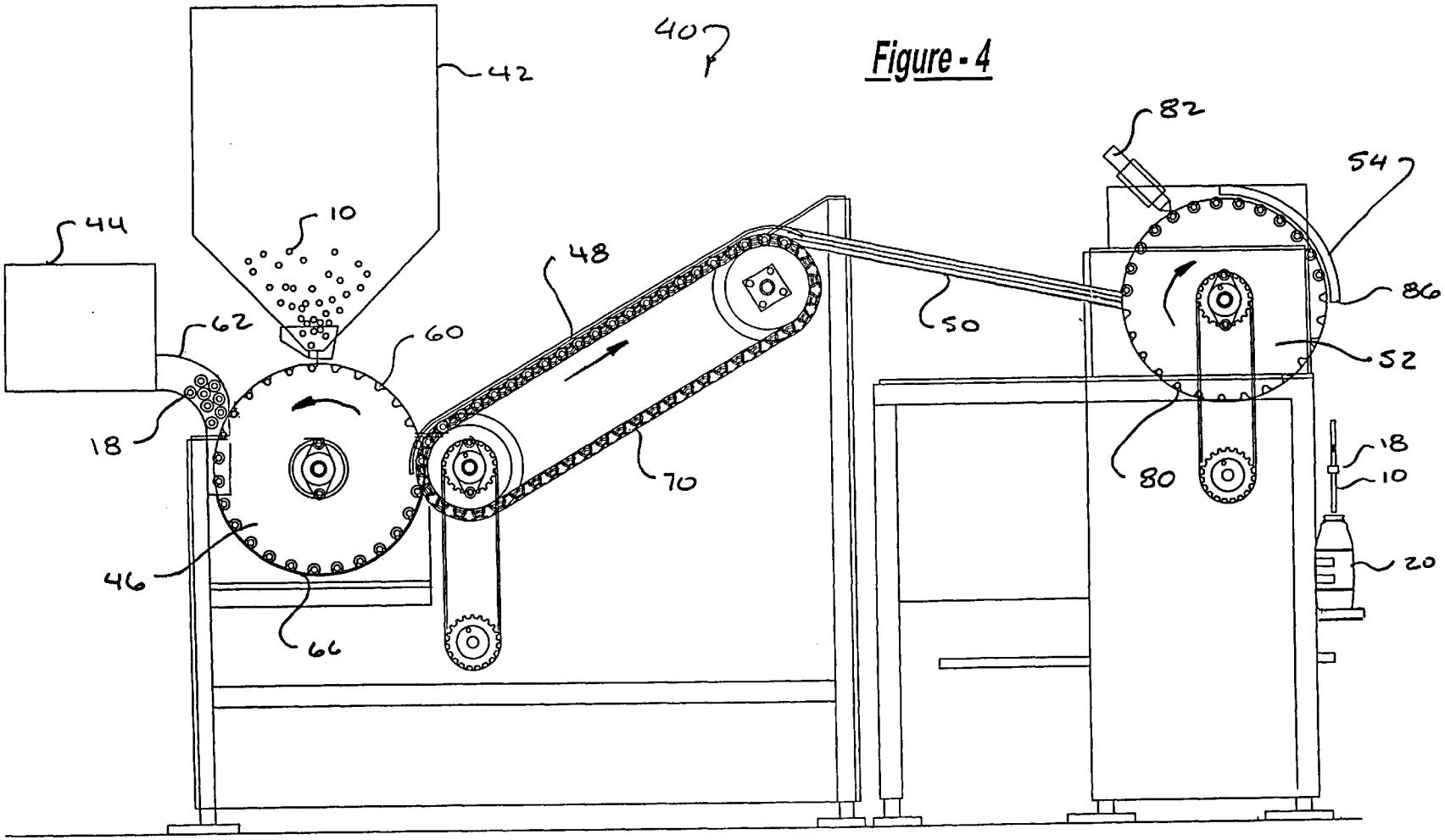
FIG. 4 is a side view of a mechanism which inserts the straw into the container in accordance with the present invention.
Figure 5:
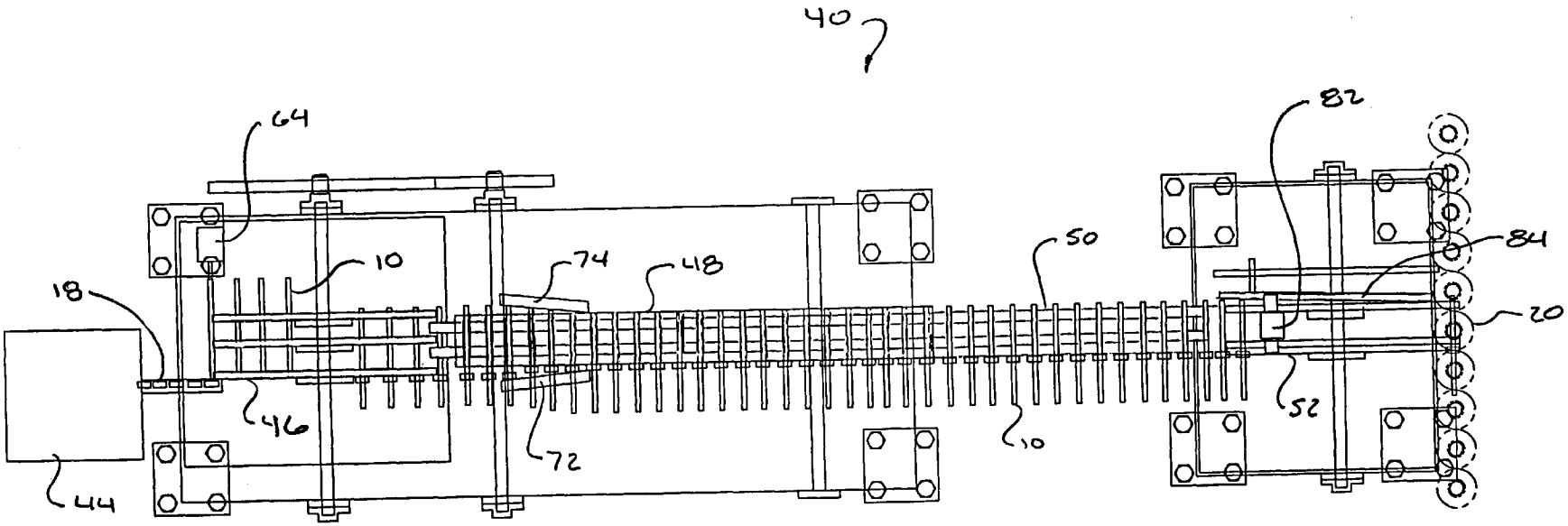
FIG. 5 is a top view of the mechanism shown in FIG. 4.

Referring now to FIGS. 4 and 5, a mechanism 40 for assembling straw 10 within container 20 is disclosed. Mechanism 40 comprises a hopper 42, a vibratory or centrifugal feeder 44, a float assembly wheel 46, a positioning track 48, a feeding track 50, a feeding wheel 52 and a positioning system 54.

Hopper 42 is filled with a plurality of straws 10 in a straightened condition. Each of straws 10 within hopper 42 do not include lifter 18. Hopper 42 gravity feeds straws 10 to float assembly wheel 46 which rotates in a counterclockwise direction as shown in FIG. 4. Wheel 46 includes a plurality of notches 60 each of which receives one straw 10. Vibratory or centrifugal feeder 44 is filled with a plurality of lifters 18. Each lifter 18 is a generally cylindrical member having a centrally located bore for receiving a respective straw 10. Vibratory feeder 44 feeds lifter 18 into a track 62 which turns to be generally vertical adjacent wheel 46. Track 62 positions an individual lifter 18 adjacent a respective notch 60 of wheel 46 which contains a respective straw 10. An assembly device 64 engages straw 10 with lifter 18 and the assembled straw 10 and lifter 18 proceed around wheel 46 within notch 60. A retaining plate 66 prevents the assembled straw 10 and lifter 18 from falling from notch 60.

Wheel 46 engages with positioning track 48 and feeds each straw 10 assembled to lifter 18 to individual pockets 70 located on track 48. As straws 10 and lifters 18 proceed up track 48, a pair of positioning plates 72 and 74 engage straw 10 and lifter 18, respectively, to place lifter 18 at a specified position on straw 10. Straws 10 and lifters 18 proceed up to the top end of track 48 where they are delivered to feeding track 50. While the present invention is being described having positioning plates 72 and 74 for positioning lifter 18, it is within the scope of the present invention to utilize other positioning devices known in the art for locating lifter 18.

Feeding track 50 is located between positioning track 48 and feeding wheel 52. Straws 10 assembled with lifters 18 are delivered from track 50 to wheel 52 by track 50. Straws 10 with lifters 18 proceed along track 50 due to gravity.

Feeding wheel 52 includes a plurality of notches 80 each of which receives one straw 10 with the attached lifter 18 from track 50. Wheel 52 rotates clockwise and thus positions each straw 10 and lifter 18 adjacent a glue gun 82. Glue gun 82 dispenses a specified quantity of glue at the interface or corner of straw 10 and lifter 18. As wheel 52 continues to rotate a final positioning plate 84 pushes straw 10 further into lifter 18 such that the glue which is dispensed by gun 82 is distributed along the interface between straw 10 and lifter 18. Plate 84 moves straw 10 relative to lifter 18 to finalize the position of lifter 18 on lower tubular section 12 of straw 10. Once the final position for lifter 18 has been set, wheel 52 continues its rotation until positioning system 54 is engaged by straw 10 and lifter 18. While the present invention is being described having positioning plate 84 for positioning lifter 18, it is within the scope of the present invention to utilize other positioning devices known in the art for locating lifter 18.

Positioning system 54 is designed to rotate straw 10 and lifter 18 approximately 90° or from a horizontal position to a vertical position as shown in FIG. 4 with lower tubular section 12 being positioned to enter container 20 first. Positioning system 54 includes a stop 86 which engages upper tubular section 16 while lower tubular section 12 is left unrestrained. As wheel 52 rotates, upper tubular section 16 is held by positioning system 54 while lower tubular section 12 is free to continue its movement. Lower tubular section 12 continues it downward movement as shown in FIG. 4 while stop 86 engaging upper tubular section 16 causes the rotation of straw 10. Eventually, straw 10 and lifter 18 will reach a generally vertical position as shown in FIG. 4 and straw 10 and lifter 18 will fall from wheel 52 into a respective container 20. As shown in FIGS. 4 and 5, a plurality of containers 20 are positioned to travel past wheel 52 at a rate which is synchronized with the rotation of wheel 52. Thus, each time a straw 10 and lifter 18 are positioned to fall from a respective notch 80, a new container 20 is positioned below the falling straw 10 and lifter 18 such that each container 20 passing wheel 52 receives a single straw 10 with its attached lifter 18.

Figure 6:
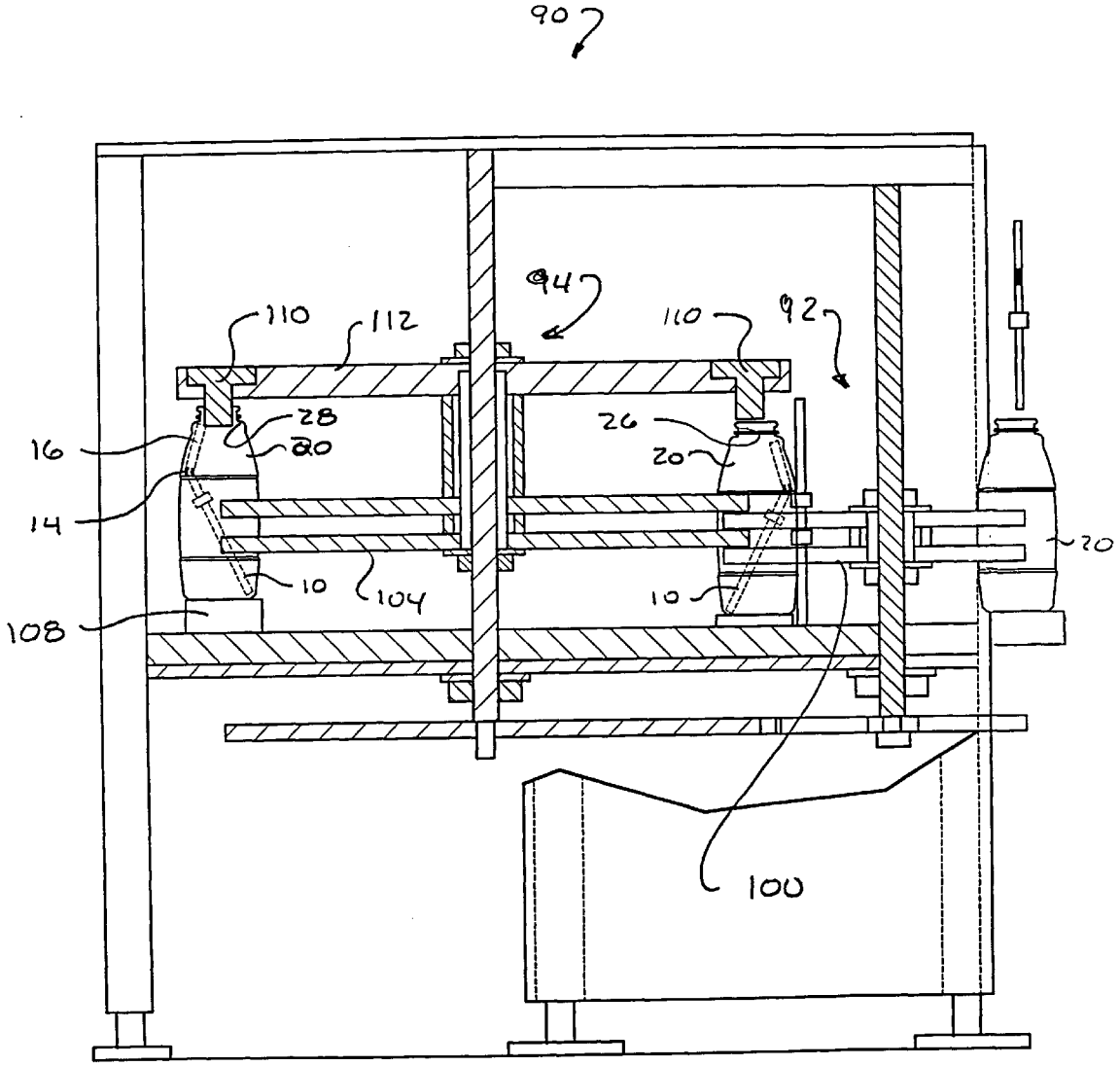
FIG. 6 is a side view of a mechanism which anchors the straw of FIG. 1 into the container of FIG. 2 in accordance with the present invention.
Figure 7:
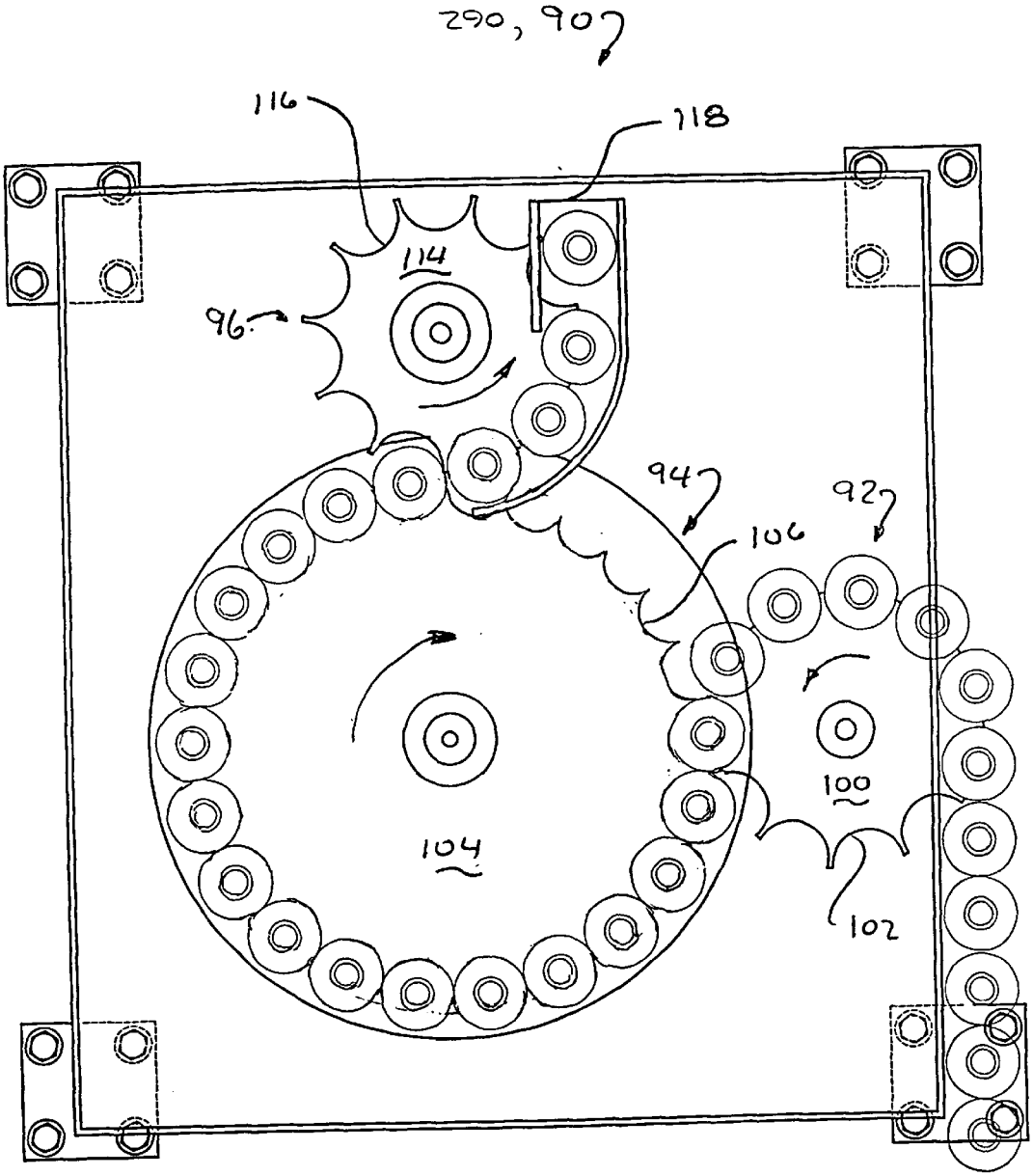
FIG. 7 is a top view of the mechanism shown in FIGS. 6 and 11.

Referring now to FIGS. 6 and 7, a mechanism 90 for retaining straw 10 and lifter 18 within container 20 is disclosed. Mechanism 90 comprises an in feeding turret 92, an anchoring turret 94 and an out feeding turret 96. In feeding turret 92 receives the plurality of containers 20 with straws 10 and lifters 18 located within them from mechanism 40. Mechanism 90 can be positioned to receive containers 20 directly from mechanism 40 or mechanism 90 can be positioned to receive containers 20 from an accumulation of containers 20 which is located between mechanisms 40 and 90. If an accumulation of containers 20 is utilized, mechanism 40 creates the accumulation of containers 20 while mechanism 90 reduces the accumulation of containers 20.

Turret 92 includes wheel 100 having the plurality of pockets 102. Each pocket 102 receives a respective container 20. Turret 92 rotates in a counterclockwise direction to feed the plurality of containers 20 to anchoring turret 94 in a predetermined spaced pattern. Turret 94 includes a wheel 104 having a plurality of pockets 106. Each pocket 106 receives a respective container 20 from turret 92. Turret 94 rotates in a clockwise direction. As turret 94 rotates, containers 20 are moved up a ramp 108. As containers 20 move up ramp 108, they are lifted such that a retaining cylinder 110 is directed through open top 26 of each container 20. A second wheel 112 includes a plurality of cylinders 110 which are spaced to align with the plurality of pockets 106. Wheel 112 is connected to and rotates with wheel 104. As each cylinder 110 enters its respective open top 26, it engages the top end of upper tubular section 16 of straw 10. Once upper tubular section 16 is engaged, continued inward movement of cylinder 110 will cause straw 10 to bend or flex at pleated section 14. Once straw 10 has bent at pleated section 14, continued inward movement of cylinder 110 will push straw 10 to the side of container 20 forcing the top end of upper tubular section 16 to engage with shoulder 28 of container 20. The flexibility of pleated section 14 creates a restoring force which then retains straw 10 within container 20. The end of each cylinder 110 is contoured in shape to urge straw 10 into engagement with shoulder 28 if desired. The contour of the end of cylinder 110 can be spheroidal, conical or any other contour which urges upper tubular section 16 into engagement with shoulder 28.

Once straw 10 has been anchored under shoulder 28, continued rotation of wheel 104 causes each container 20 to move down ramp 108 to remove cylinder 110 from container 20. Outfeeding turret 96 includes a wheel 114 having a plurality of pockets 116. Each pocket 116 receives a respective container 20. Turret 96 rotates in a counterclockwise direction to receive the plurality of containers 20 from anchoring turret 94 and feed them to a supply line 118. Supply line 118 can feed directly to a filling machine, it can feed directly to an accumulation of containers 20 in front of a filling machine or it can feed directly to a packing mechanism which loads the plurality of containers 20 with the retained straws 10 and lifters 18 into containers to be transported to a filling machine. As shown in FIG. 3, open top 26 is left open after retaining straw 10 within container 20 to allow for the filling of container 20 by the filling machine.

Figure 8:
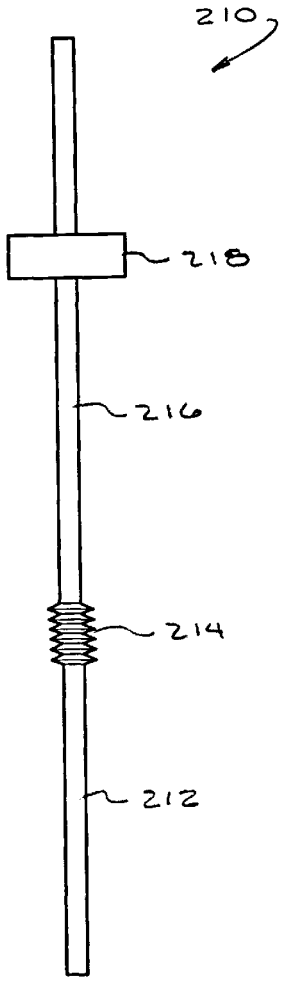
FIG. 8 is a side view of a straw in accordance with another embodiment of the present invention.

Referring now to FIG. 8, a straw which is designed to be inserted into a container in accordance with another embodiment of the present invention is illustrated and is designated generally by the reference numeral 210. Straw 210 comprises a lower tubular section 212, a pleated section 214 and an upper tubular section 216. A lifter or float 218 is secured to straw 210 to enhance the buoyancy of straw 210 but other methods of enhancing the buoyancy of straw 210 can also be used. These methods include but are not limited to coating straw 210 with a buoyant substance, placing lifters other than lifter 218 on straw 210 or integrally forming a lifter on straw 210. Similar to the previous embodiment, straw 210 is preferably inserted into a container 220 while straw 210 is in a straight position with lower tubular section 212 in alignment with upper tubular section 216 as shown in FIG. 8.

Figure 9:
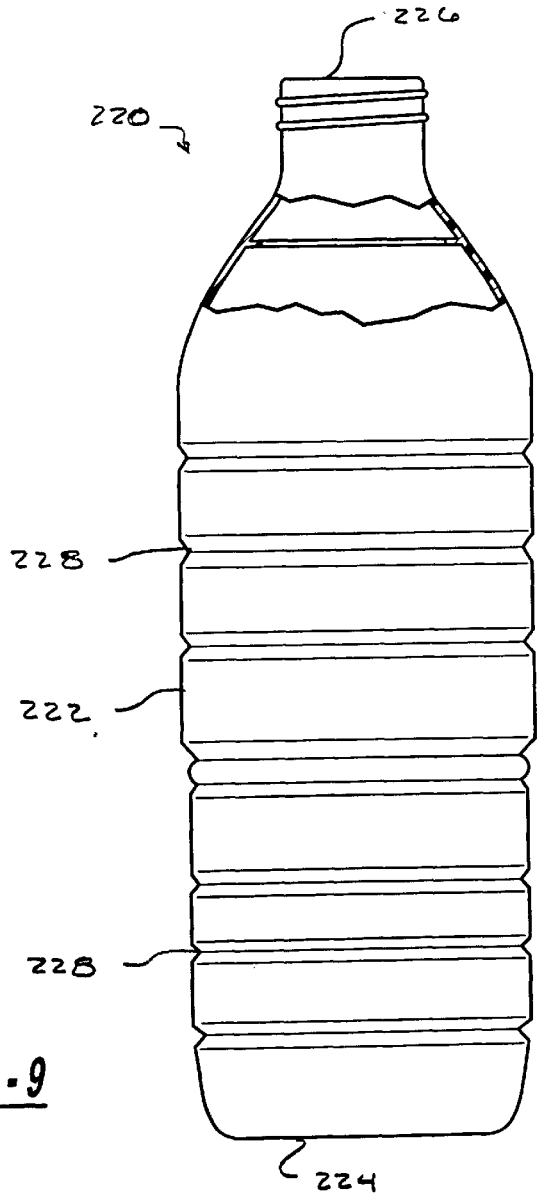
FIG. 9 is a side view partially in cross-section of a container into which the straw illustrated in FIG. 8 is to be inserted.

Referring now to FIG. 9, container 220 comprises a generally cylindrical body 222, a closed bottom 224, an open top 226 and a plurality of annular ribs 228 located along the length of cylindrical body 222 to provide stiffness for cylindrical body 222. Since at least one rib 228 is utilized for retaining straw 210, cylindrical body 222 must have at least one rib 228.

Figure 10:
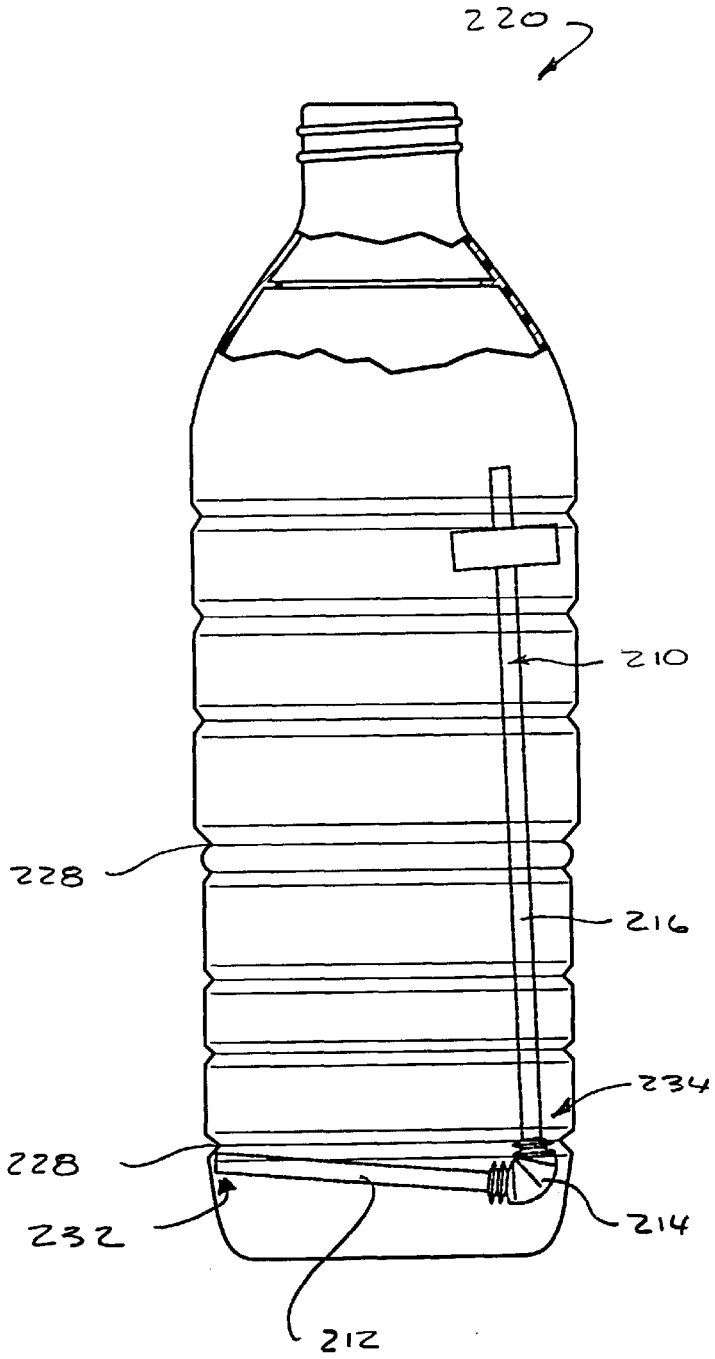
FIG. 10 is a side view, partially in cross-section, of the straw shown in FIG. 8 assembled into the container shown in FIG. 9.

Referring now to FIG. 10, straw 210 is shown releasably retained within container 220 which is the position prior to being fed to a high speed filling line for container 220. Straw 210 is retained at its lower end by being positioned below one of ribs 228 as shown at 232 in FIG. 10 and retained at a position on pleated section 214 or upper tubular section 216 which is also positioned below one of ribs 228 as shown at 234. While straw 210 is shown being retained at both positions 232 and 234 by the same rib 228, it is within the scope of the present invention to use two different ribs 228 if desired. Straw 210 is bent at pleating section 214 and is held in the position shown due to the flexing of pleated section 214. When straw 210 is bent at pleated section 214, the elasticity of the material for pleated section 214 creates a restoring force which urges straw 210 back into its straight position. This restoring force acts against rib 228 to retain straw 210 within container 220. When straw 210 is to be released, the outer surface of container 220 is flexed inward adjacent the respective rib 228 to release straw 210 from rib 228.

The assembly of straw 210 within container 220 may be accomplished in the same manner as the assembly of straw 10 within container 20. This is illustrated in FIGS. 4 and 5 where mechanism 40 comprises hopper 42, vibratory feeder 44, lifter assembly wheel 46, positioning track 48, feeding track 50, feeding wheel 52 and positioning system 54.

Figure 11:
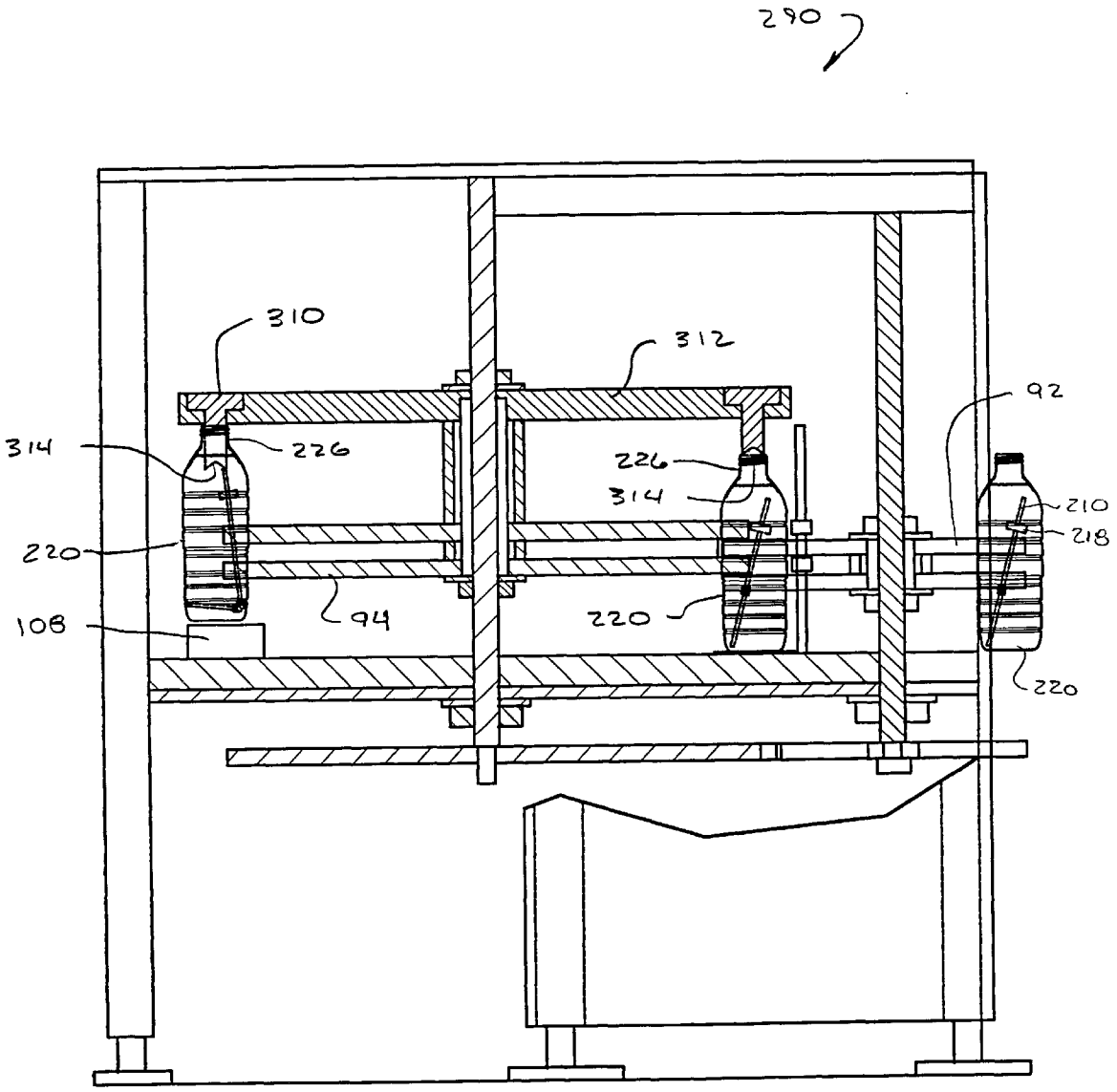
FIG. 11 is a side view of a mechanism which anchors the straw of FIG. 8 into the container of FIG. 9 in accordance with the present invention.

Referring now to FIGS. 7 and 11, a mechanism 290 for retaining straw 210 and lifter 218 within container 220 is disclosed. Mechanism 290 comprises in feeding turret 92, anchoring turret 94 and out feeding turret 96. In feeding turret 92 receives the plurality of containers 220 with straws 210 and lifter 218 located within them from mechanism 40. Mechanism 90 can be positioned to receive containers 220 directly from mechanism 40 or mechanism 90 can be positioned to receive containers 220 from an accumulation of containers 220 which is located between mechanisms 40 and 90 similar to that described above for containers 20.

Turret 92 includes wheel 100 having the plurality of pockets 102. Each pocket 102 receives a respective container 220. Turret 92 rotates in a counterclockwise direction to feed the plurality of containers 220 to anchoring turret 94 in a predetermined spaced pattern. Turret 94 includes a wheel 104 having the plurality of pockets 106. Each pocket 106 receives a respective container 220 from turret 92. Turret 94 rotates in a clockwise direction. As turret 94 rotates, containers 220 are moved up ramp 108. As containers 220 move up ramp 108, they are lifted such that a retaining cylinder 310 is directed through open top 226 of each container 220. A second wheel 312 includes a plurality of cylinders 310 which are spaced to align with the plurality of pockets 106. Wheel 312 is connected to and rotates with wheel 104. As each cylinder 310 enters its respective open top 226, it engages the top end of upper tubular section 216 of straw 210. A concave surface 314 on the end of each cylinder 310 captures the respective end of straw 210 in order to complete the retention process. Once upper tubular section 216 is engaged by surface 314, continued inward movement of cylinder 310 will cause straw 10 to bend or flex at pleated section 214. Once straw 210 has bent at pleated section 214, continued inward movement of cylinder 310 will push straw 210 towards the inside surface of container 220 forcing the engagement with rib 228 at positions 232 and 234 as shown in FIG. 10. The flexing of pleated section 214 creates a restoring force which then retains straw 210 within container 220.

Once straw 210 has been anchored under rib 228, continued rotation of wheel 104 will cause each container 220 to move down ramp 108 to remove cylinder 310 from container 220. Outfeeding turret 96 includes wheel 114 having the plurality of pockets 116. Each pocket 116 receives a respective container 220. Turret 96 rotates in a counterclockwise direction to receive the plurality of containers 220 from anchoring turret 94 and feed them to supply line 118. Supply line 118 can feed directly to a filling machine, it can feed directly to an accumulation of containers 220 in front of a filling machine or it can feed directly to a packaging mechanism which loads the plurality of containers 220 with the retained straws 210 and lifters 218 into containers to be transported to a filling machine, or any combination thereof.

Figure 12:
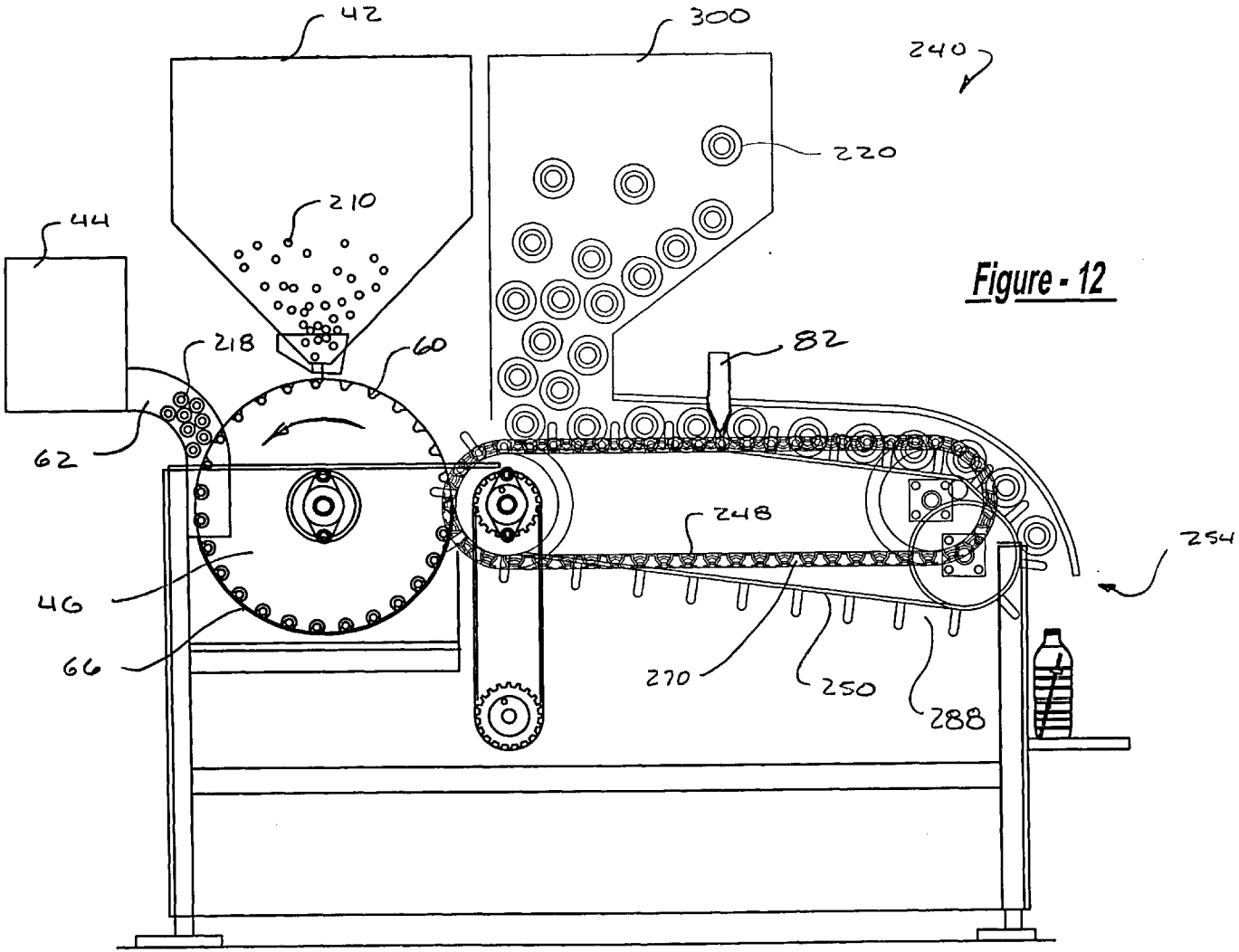
FIG. 12 is a side view of a mechanism which inserts the straw into the container in accordance with another embodiment of the present invention.
Figure 13:
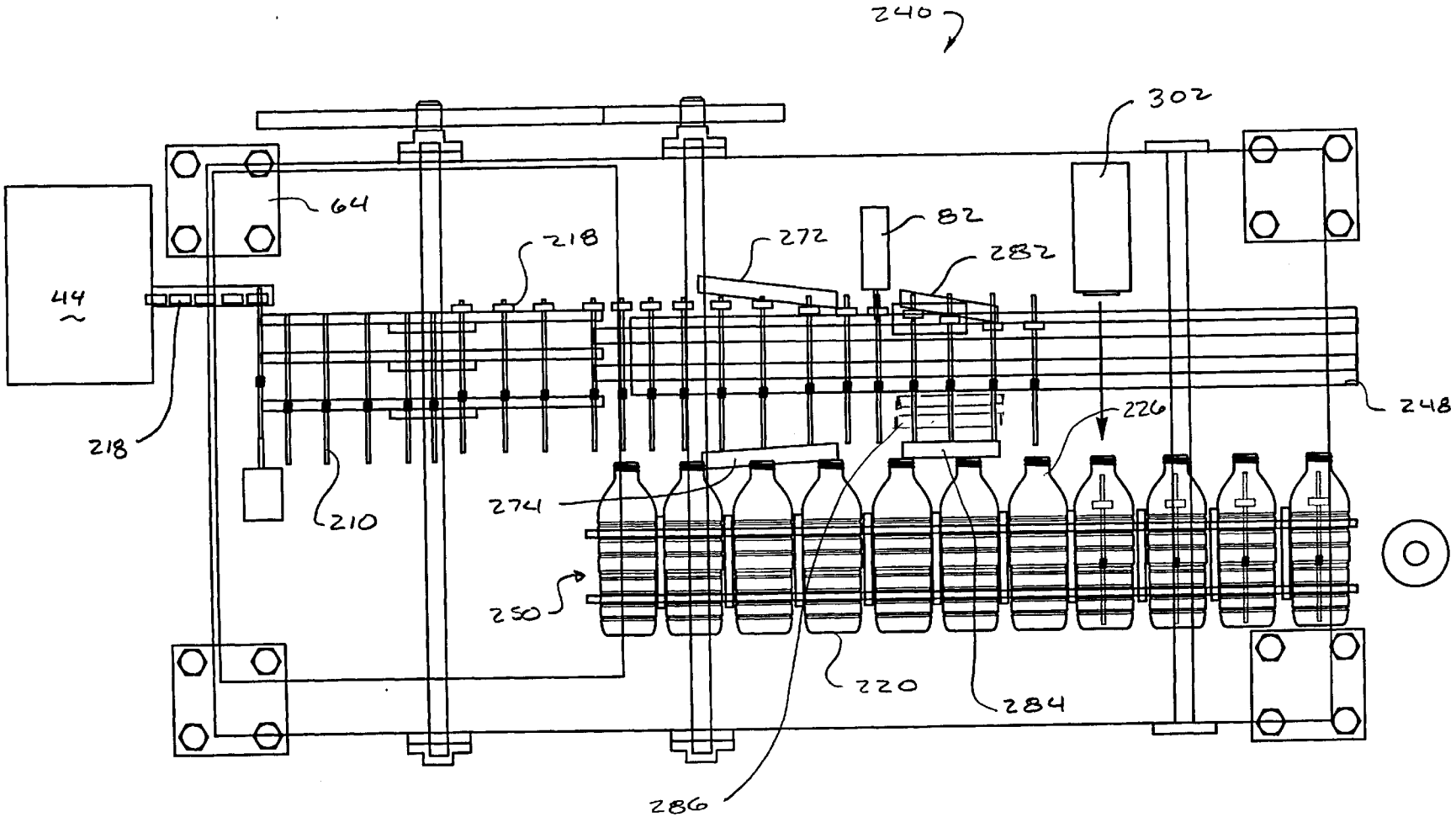
FIG. 13 is a top view of the mechanism shown in FIG. 12.

As stated above for the first two embodiments, straw 10 is assembled with container 20 and straw 210 is assembled with container 220 using mechanism 40. FIGS. 12 and 13 illustrate a mechanism 240 which is designed to assemble straw 10 with container 20 and/or straw 210 with container 220. Mechanism 40 is designed to operate with containers 20 and 220 being located in a vertical position as shown in FIGS. 4 and 5. Mechanism 240 is designed to operate with containers 20 and 220 being located in a horizontal position as shown in FIGS. 12 and 13. Mechanism 240 comprises hopper 42, vibratory or centrifugal feeder 44, float assembly wheel 46, a positioning track 248, a container feeding track 250 and a container rotating system 254.

Hopper 42 is filled with a plurality of straws 10 or 210 in a straightened condition. Each of straws 10 or 210 within hopper 42 does not include lifter 18 or 218, respectively. Hopper 42 gravity feeds straws 10 or 210 to float assembly wheel 46 which rotates in a counterclockwise direction as shown in FIG. 12. Wheel 46 includes the plurality of notches 60 each of which receives one straw 10 or 210. Vibratory or centrifugal feeder 44 is filled with a plurality of lifters 18 or 218. Each lifter 18 or 218 is a generally cylindrical member having a centrally located bore for receiving a straw 10 or 210, respectively. Vibratory or centrifugal feeder 44 feeds lifter 18 or 218 into track 62 which turns to be generally vertical adjacent wheel 46. Track 62 positions an individual lifter 18 or 218 adjacent a respective notch 60 which contains straw 10 or 210. Assembly device 64 engages straw 10 or 210 with lifter 18 or 218, respectively and the assembled straw 10 and lifter 18 or the assembled straw 210 and lifter 218 proceed around wheel 46 within notch 60. A retaining plate 66 prevents the assembled straw 10 or 210 and lifter 18 or 218, respectively, from falling from notch 60.

Wheel 46 engages with positioning track 248 and feeds each straw 10 or 210 assembled to lifter 18 or 218, respectively, to individual pockets 270 located on track 248. As straws 10 and lifters 18 or straws 210 and lifters 218 proceed along track 248 a pair of positioning plates 272 and 274 engage each straw 10 or 210 and each lifter 18 or 218, respectively, to place lifter 18 at a first specified position on straw 10 or to place lifter 218 at a first specified position on straw 210. The first specified position for float 18 or 218 can be adjusted by adjusting the position of plates 272 and 274. After lifter 18 or 218 is positioned at its first specified position, glue gun 82 dispenses a specified quantity of glue at the interface or corner of straw 10 or 210 and lifter 18 or 218, respectively. As positioning track 248 continues to move, a final pair of positioning plates 282 and 284 push straw 10 or 210 further into lifter 18 or 218, respectively, such that the glue which is dispensed by gun 82 is distributed along the interface between straw 10 or 210 and lifter 18 or 218, respectively. A pair of plates 286 cause rotation of straw 10 or 210 during this final positioning move to ensure complete distribution of the glue. While final positioning plates 282 and 284 are illustrated as forcing lifter 18 or 218 further onto straw 10 or 210, it is within the scope of the present invention to position plates 282 and 284 such that lifter 18 or 218 is moved in the opposite direction in order to reach its final position. In this manner, any glue ridge which may be left after the final position can be located in the direction of the top or bottom of the straw at the designer's preference.

As positioning track 248 continues to move, each straw 10 or 210 assembled with lifter 18 or 218, respectively, align with a respective opening 26 or 226 in a horizontally positioned container 20 or 220. Containers 20 or 220 are being fed to a position adjacent positioning track 248 by container feeding track 250 which moves in the same direction as positioning track 248. Container feeding track 250 defines a plurality of pockets 288 each of which receive a respective container 20 or 220 from a supply of empty containers 20 or 220. In the embodiment shown, containers 20 or 220 are supplied from a container hopper 300. At the same time that each straw 10 or 210 assembled with lifter 18 or 218, respectively, aligns with opening 26 or 226, an insertion mechanism 302 pushes straw 10 or 210 and lifter 18 or 218, respectively, into container 20 or 220 through opening 26 or 226, respectively. Mechanism 300 can be an air jet, a pneumatically, hydraulically, magnetically or electrically driven piston, a cam, an arm or a robot.

Once straw 10 or 210 with its attached lifter 18 or 218, respectively, is assembled into container 20 or 220, container feeding track 250 moves containers 20 or 220 to container rotating system 254. Rotating system 254 rotates each container 20 or 220 90° (or from its horizontal position to its vertical position) with opening 26 or 226 positioned upward. Once located in its vertical position, containers 20 or 220 can be fed to an accumulator of containers for mechanism 90 or 290 or containers 20 or 220 can be fed directly to mechanism 90 or 290.

As stated above, when straw 10 is to be released from its position shown in FIG. 3, the outer surface of container 20 is flexed inward adjacent shoulder 18 to release straw 10 from beneath shoulder 28. This operation is normally completed after the filling and capping of container 20 and if desired, it can be incorporated into the filling and capping machine, it can be completed after exiting the capping machine, it can be a separate operation or it can be left to the consumer to release straw 10 prior to opening container 20.

Figure 14:
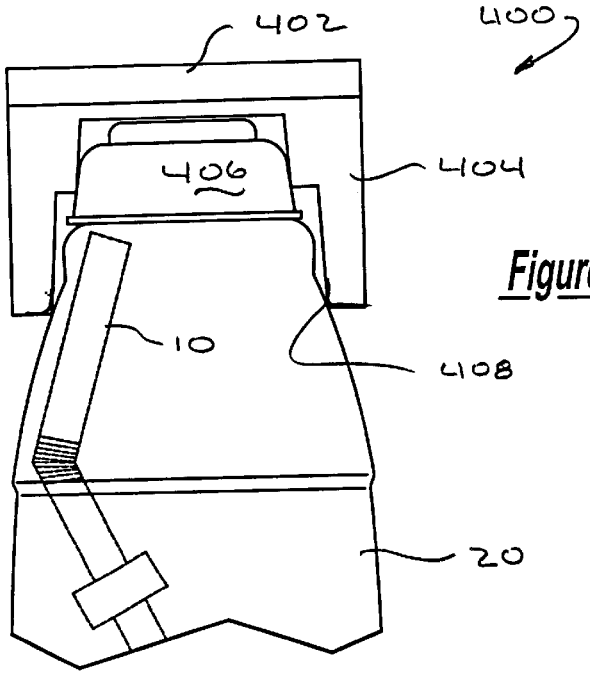
FIG. 14 is a side view, partially in cross-section, of a mechanism for releasing the straw in accordance with the present invention.

Referring now to FIG. 14, a releasing device 400 for straw 10 and container 20 is illustrated. Releasing device 400 comprises a capper plate 402 and an arming device 404. Capper plate 402 is associated with the machine that places a cap 406 over open top 26 of container 20. Capper plate 402 completes the assembly of cap 406 to container 20. While capper plate 402 is being described as being associated with the machine that caps containers 20, it is within the scope of the present invention to alternatively incorporate capper plate 402 into a dedicated releasing machine if desired. Releasing device 404 is an annular ring which is secured to capper plate 402. Releasing device 404 is sized in diameter to go over container 20 and cap 406 and is sized in length to flex body 22 of container 20 at a position adjacent the upper end of straw 10. A chamfered or rounded surface 408 presents a friendly surface to container 20 during this operation. When surface 408 contacts and flexes inward the portion of body 22 adjacent straw 10, straw 10 is forced radially inward to a position where straw 10 can move into open end 26 of container 20 awaiting the removal of cap 406 and the subsequent movement out of container 20 for the convenience of the consumer. Releasing device 404 may also contain rollers, similar to rollers 422 and 424 described below if desired. While releasing device 404 releases straw 10, capper plate 402 ensures that cap 406 will remain in place should the pressure within container 20 increase as a result of the flexing of body 22.

Figure 15A:
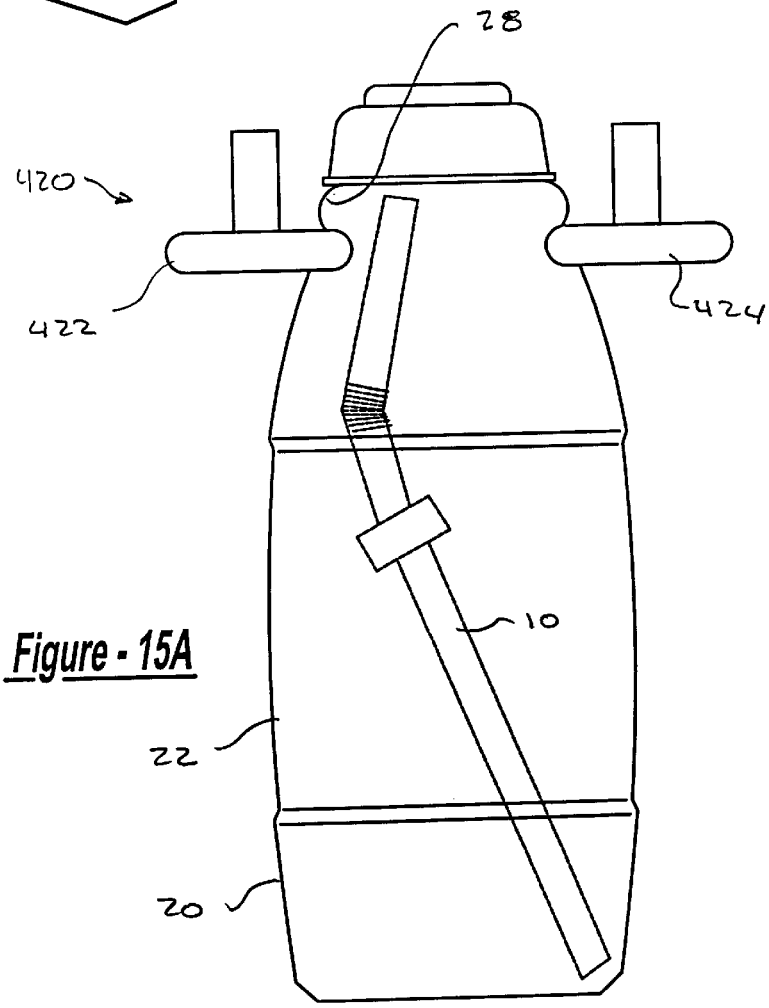
FIGS. 15A and 15B are each a side view, partially in cross-section, of a mechanism for releasing the straw in accordance with other embodiments of the present invention.
Figure 15B:
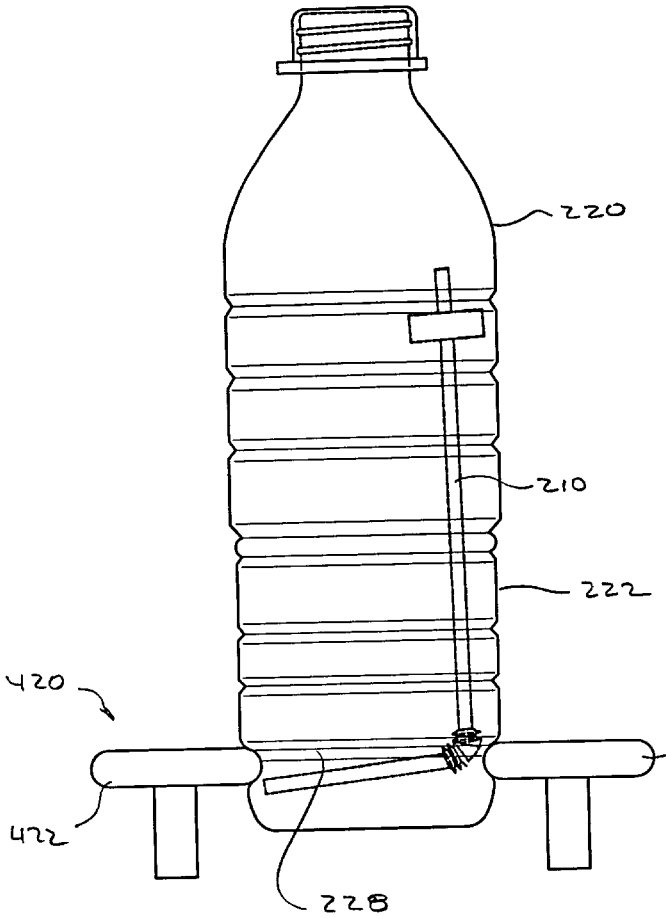
Figure 16B:
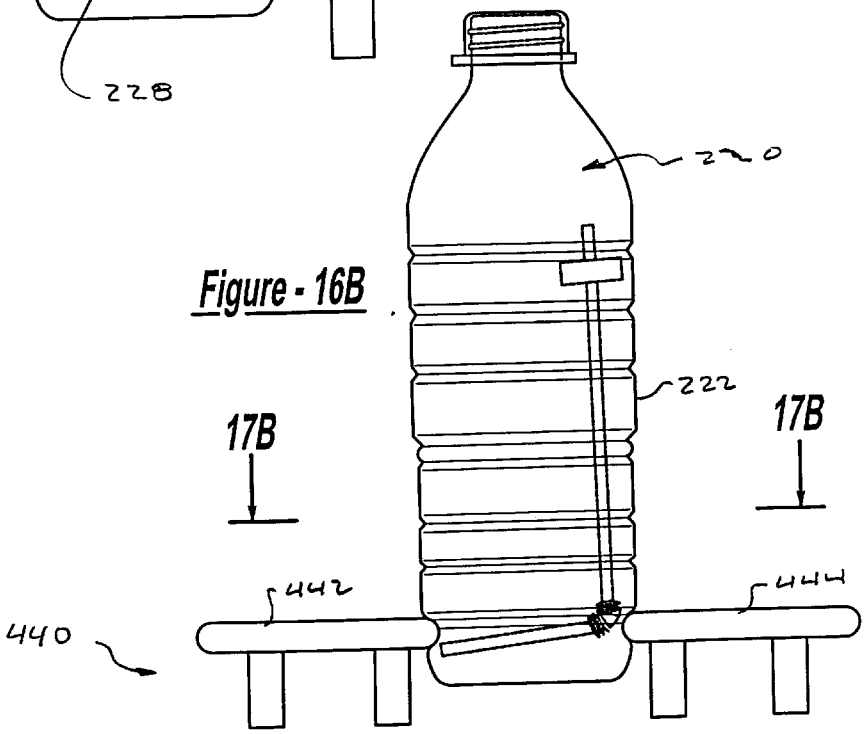
FIGS. 16A and 16B are each a side view, partially in cross-section, of a mechanism for releasing the straw in accordance with other embodiments of the present invention.
Figure 16A:
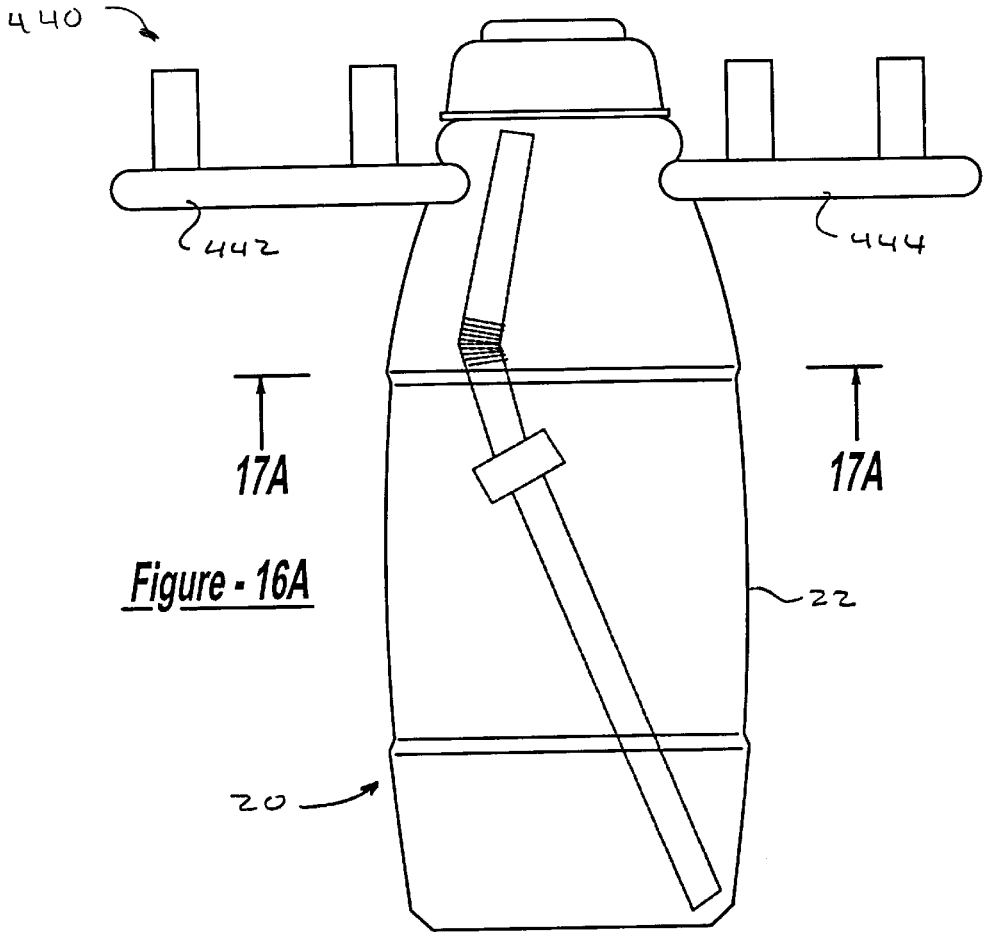
Figure 17A:
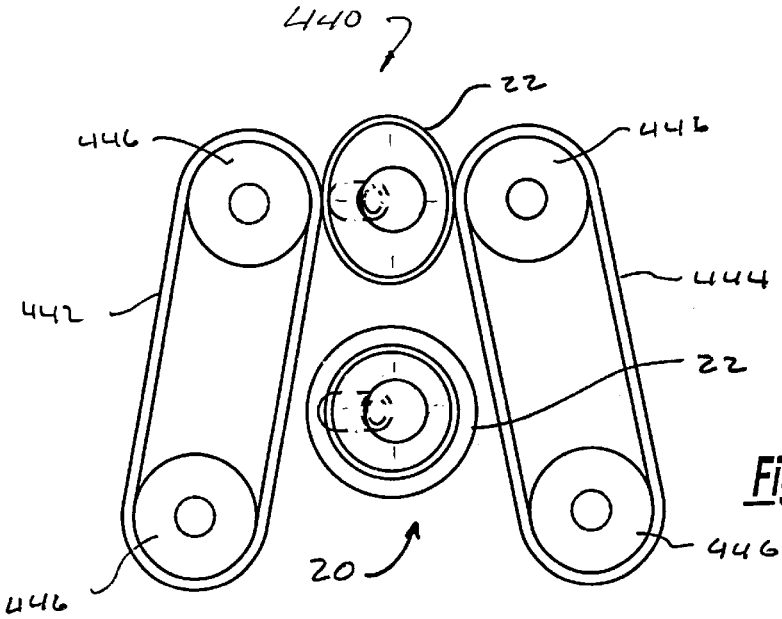
FIGS. 17A and 17B are a plan view of the mechanism shown in FIGS. 16A and 16B, respectively.
Figure 17B:
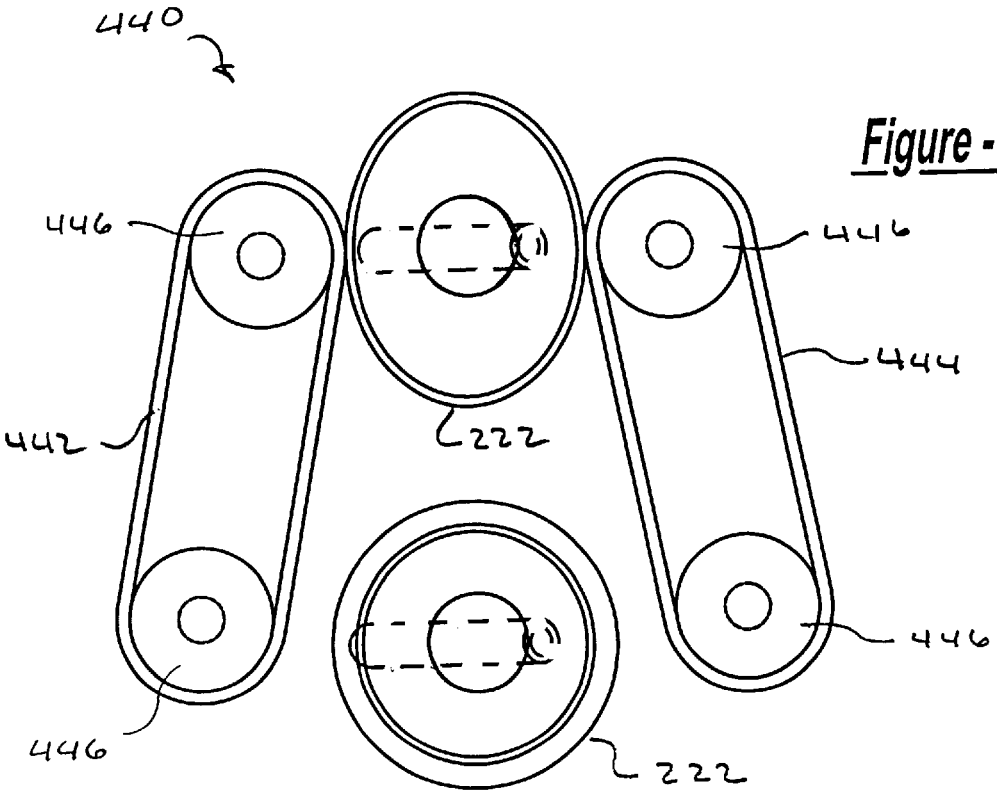

Referring now to FIGS. 15A and 15B, a releasing device 420 for straw 10 or 210 and container 20 or 220 is illustrated.

Releasing device 420 comprises a first roller 422 and a second roller 424. Rollers 422 and 424 are spaced apart a specified distance such that body 22 of container 20 or body 222 of container 220 is flexed inward enough to release straw 10 or 210, respectively. One or both of rollers 422 and 424 are rotated such that container 20 or 220 rotates as it passes between rollers 422 and 424 to ensure that the entire surface of body 22 or 222 is flexed inward. This will release straw 10 or 210 regardless of its orientation within container 20 or 220, respectively. In order to have containers 20 or 220 feed into rollers 422 and 424, the center of rotation of each roller can be offset from each other if desired. The width of rollers 422 and 424 is chosen such that body 22 or 222 is flexed inward sufficiently to release straw 10 or 210. FIG. 15A illustrates rollers 422 and 424 being positioned immediately below shoulder 28 of container 20 to release straw 10. FIG. 15B illustrates rollers 422 and 424 being positioned immediately below rib 228 of container 220 to release straw 210. Similar to FIG. 14, the devices in FIGS. 15A and 15B can incorporate a device for maintaining the position of cap 406 if necessary.

Referring now to FIGS. 16A, 16B, 17A and 17B, a releasing device 440 for straw 10 or 210 and container 20 or 220 is illustrated. Releasing device 440 comprises a first belt or cable 442 and a second belt or cable 444. Belts 442 and 444 are spaced apart a specified distance such that body 22 of container 20 or body 222 of container 220 is flexed inward enough to release straw 10 or 210, respectively. One or both belts 442 and 444 are driven by one or more pulleys 446 such that container 20 or 220 rotates as it passes between belts 442 and 444 to ensure that the entire surface of body 22 or 222 is flexed inward. This will release straw 10 or 210 regardless of its orientation within containers 20 or 210, respectively. In order to have containers 20 or 220 feed into belts 442 and 444, belts 442 and 444 can be offset with respect to each other and/or belts 442 and 444 can be angled with respect to each other to form a funnel shaped entrance if desired. Another option would be to replace each belt 442 and 444 with a solid bar. The solid bars can be designed to translate with respect to each other and they can also be offset with respect to each other and/or angled with respect to each other to form the funnel shaped entrance. Similar to FIG. 14, the devices in FIGS. 16A, 16B, 17A and 17B can incorporate a device for maintaining the position of cap 46 if necessary.

Figure 18:
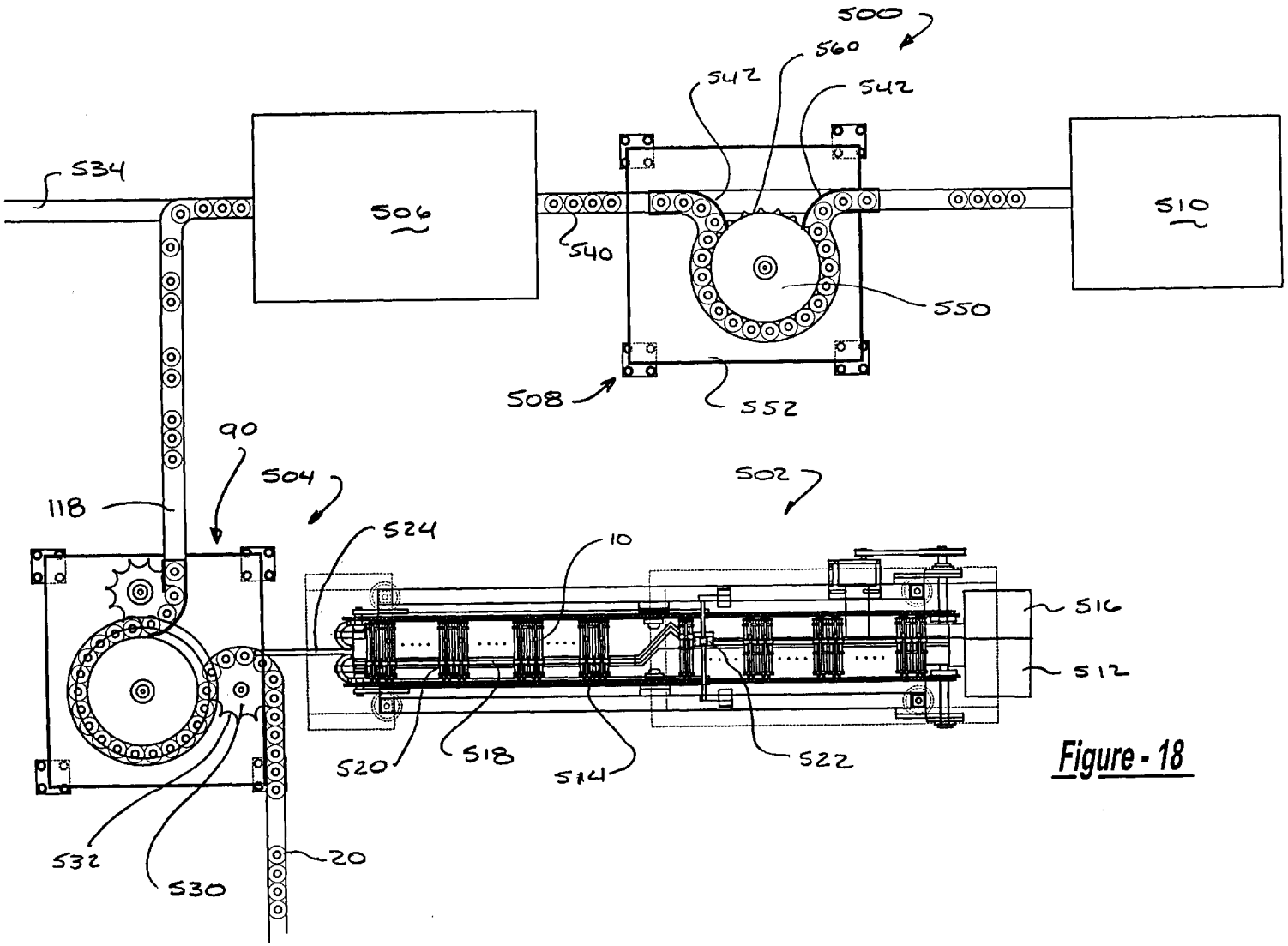
FIG. 18 is a plan view of a mechanism which inserts a straw into a container in accordance with another embodiment of the present invention.
Figure 19:
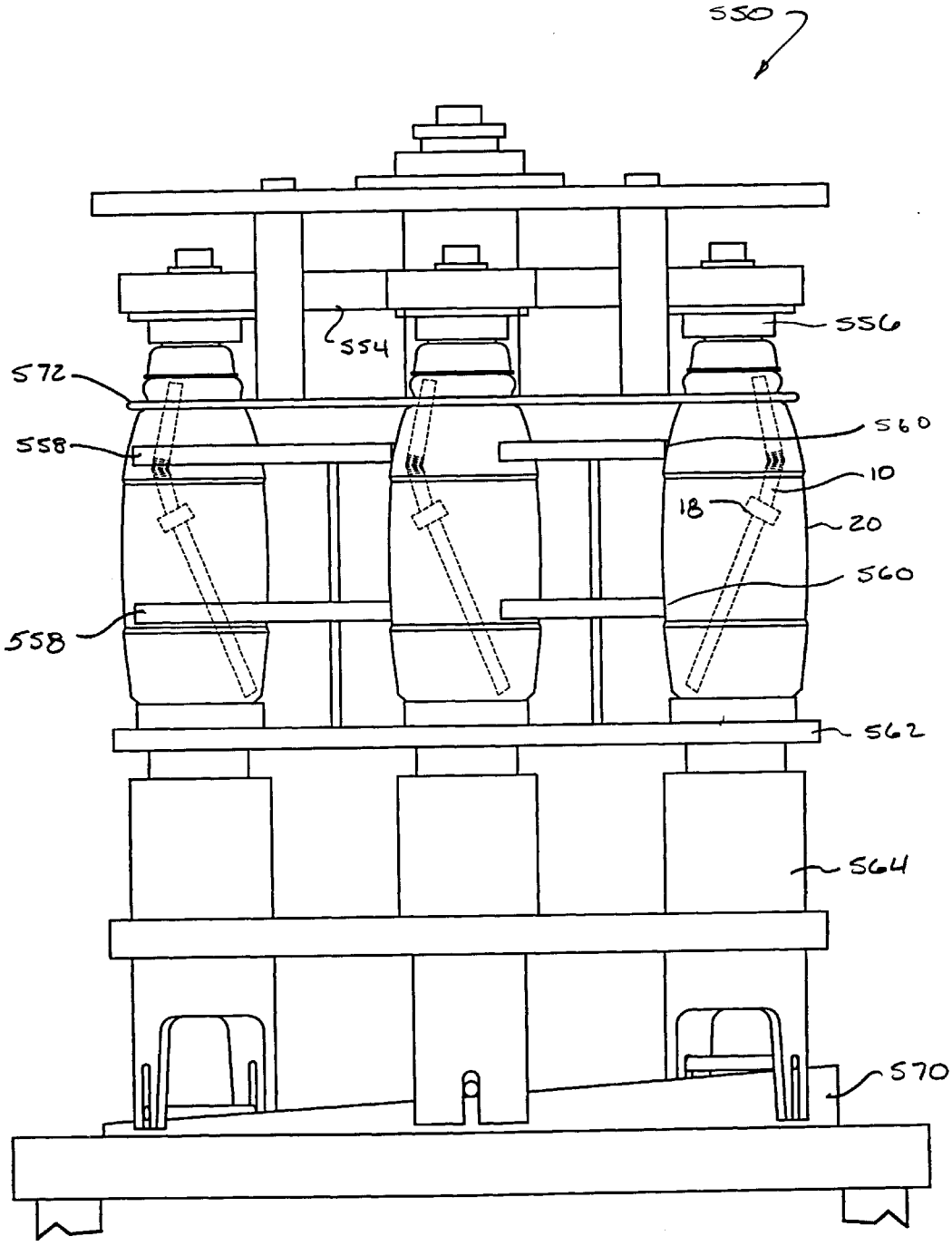
FIG. 19 is a side view of the straw release mechanism shown in FIG. 18.
Figure 19A:
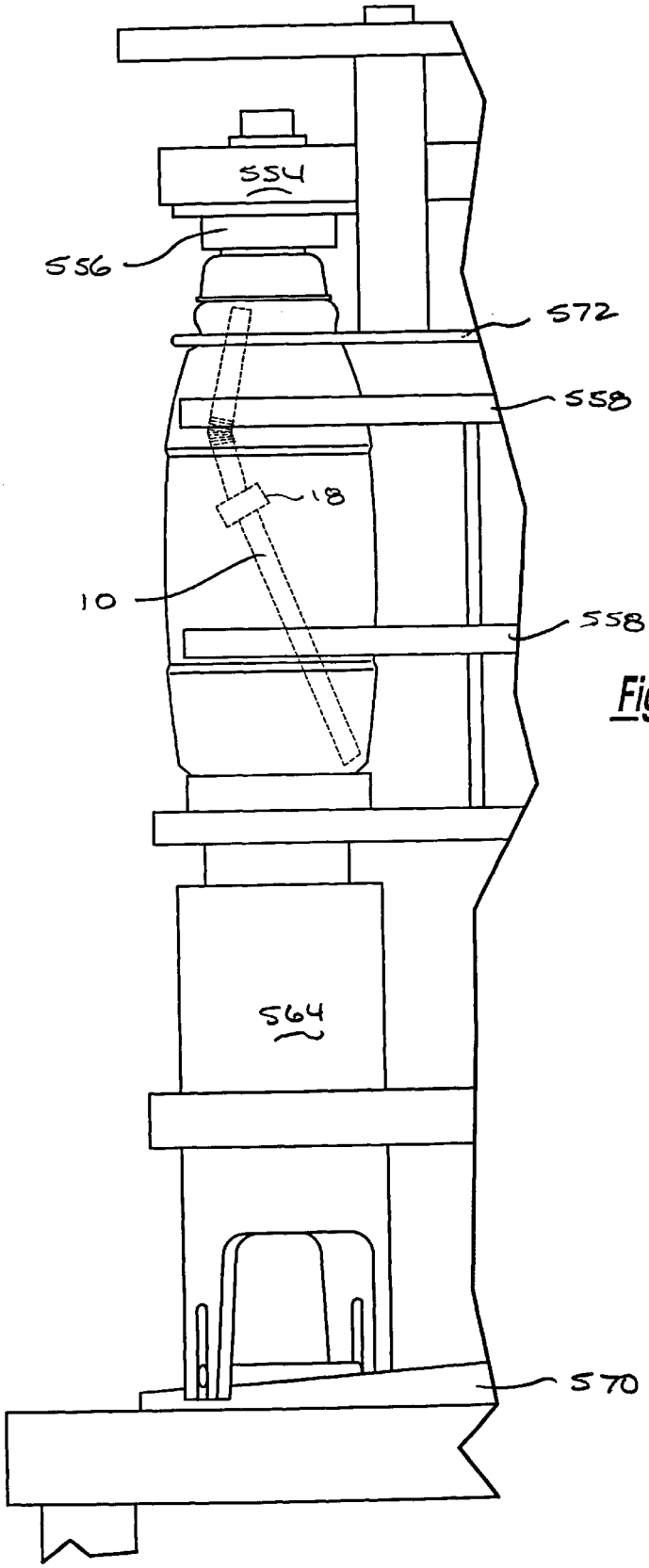
FIG. 19A is an enlargement of one container shown in FIG. 19.

Referring now to FIGS. 18–19A, a mechanism 500 for including straw 10 with lifter 18 within container 20 is disclosed. Mechanism 500 comprises a straw and lifter assembly device 502, a straw insertion and arming device 504, a filling and capping system 506, a releasing device 508 and a packaging system 510.

Lifter assembly device 502 includes a hopper or vibratory feeder 512 which feeds an individual straw 10 to each of a plurality of carriages 514, and a hopper or vibratory feeder 516 which fees an individual lifter 18 to each of the plurality of carriages 514. As each of carriages 514 moves longitudinally along device 502, a cam track 518 moves a slide 520 longitudinally (perpendicular to the movement of carriages 514) along each carriage 514. A gluing station 522 applies a specified amount of glue or adhesive on straw 10 after which cam track 518 moves lifter 18 over the adhesive to complete the bonding of lifter 18 to straw 10. Carriage 514 continues along device 502 until it reaches the end of the device at which time an unloading station 524 removes straw 10 and lifter 18 from each carriage 514, rotates it from a horizontal position to a vertical position and delivers it to straw insertion and arming device 504. Each carriage 514 is attached to an endless bolt which returns each carriage 514 back to the beginning of device 502 for the receipt and assembly of another straw 10 and lifter 18.

Straw insertion and arming device 504 includes a straw and lifter turret 530 and mechanism 90 shown in FIGS. 6 and 7. Mechanism 90 includes in feeding turret 92 which receives a respective container 20 in each of its pockets 102. As described above for FIGS. 6 and 7, in feeding turret 92 receives the plurality of containers 20 with straws 10 and lifters 18 located within them. For device 502, feeding turret 92 receives the plurality of containers 20 without straws 10 and lifters 18 located within them. Straw and lifter turret 530 includes a plurality of pockets 532. Each pocket 532 receives a respective straw 10 with lifter 18 from unloading station 524. Turret 530 is preferably located on the same shaft as in feeding turret 92 and rotates synchronously with in feeding turret 92. Turret 530 is rotationally positioned to align pockets 532 with pockets 102 and thus align an individual straw 10 with lifter 18 above the opening in each container 20. Once straw 10 with lifter 18 is aligned with the opening in its respective container 20, the retention mechanism holding straw 10 within its respective pocket 532 is released and straw 10 with lifter 18 drops into container 20. Once straw 10 with lifter 18 has been dropped into container 20, the retention arming or anchoring of straw 10 within container 20 proceeds as described above for mechanism 90 and FIGS. 6 and 7. The retention mechanism for holding straw 10 within pocket 532 can be a mechanical device, a pneumatic device or any other mechanism known in the art.

Containers with straw 10 and lifter 18 in an anchored position leave mechanism 90 on supply line 118 and are fed directly to filling and capping system 506. Filling and capping system 506 is known well in the art and details of this system will not be detailed. An auxiliary supply line 534 joins with supply line 118. Supply line 534 is utilized when it is desired to fill containers 20 without straws 10 and lifters 18 positioned within them. Supply line 534 permits the filling of these "empty" containers without having to run containers 20 through mechanism 90.

Filled and capped containers 20 exit system 506 along a supply line 540 which feeds them to releasing device 508. Supply line 540 includes a set of diverters 542 which are utilized to direct containers 20 into and out of releasing device 508. When filling containers 20 without straws 10, diverters 542 are moved to bypass releasing device 508 and deliver the filled containers directly to packaging system 510.

Releasing device 508 includes a turret 550 rotatably disposed on a support structure 552. Turret 550 rotates with respect to support structure 552 in order to take each container 20 through a releasing mechanism which releases straw 10 from its armed position from mechanism 90.

Referring now to FIGS. 19 and 19A, turret 550 includes an upper support plate 554 having a plurality of rotatable backing heads 556; a pair of container receiving plates 558, each having a plurality of pockets 560; and a lower support plate 562 having a plurality of rotatable and axially movable support bases 564. Heads 556, pockets 560 and bases 564 are each in registry with each other such that an individual container 20 is received within each respective set of heads 556, pockets 560 and bases 564. As each container 20 is fed to release device 508, turret 550 receives container 20 in one set of pockets 560 with container 20 sitting on base 564 spaced from head 556. As turret 550 rotates, a cam 570 positioned below bases 564 moves base 564 upward such that container 20 engages head 556. Continued rotation of turret 550 causes container 220 to engage a stationary generally circular rail 572. Engagement with rail 572 causes rotation of container 20 on rotatable head 556 and rotatable base 564. As container 20 rotates, the engagement with rail 572 also compresses the sidewall of container 20 to push straw 10 out of its armed position. The length of rail 572 is designed to cause approximately two revolutions of container 20 thereby ensuring the release of straw 10. One of the reasons for securing container 20 between heads 556 and bases 564 by the axial movement of bases 664 is to ensure that the compression of the side wall of container 20 does not cause internal pressure within container 20 or sufficient distortion of container 20 which could unseat the cap which seals container 20 after filling. Continued rotation of turret 550 causes cam 570 to lower container 20 and finally feeding container 20 back onto supply line 540.

Once back onto supply line 540, containers 20 are fed to packaging system 510. Packaging system 510 is well known in the art and thus will not be detailed further herein.

Figure 20:
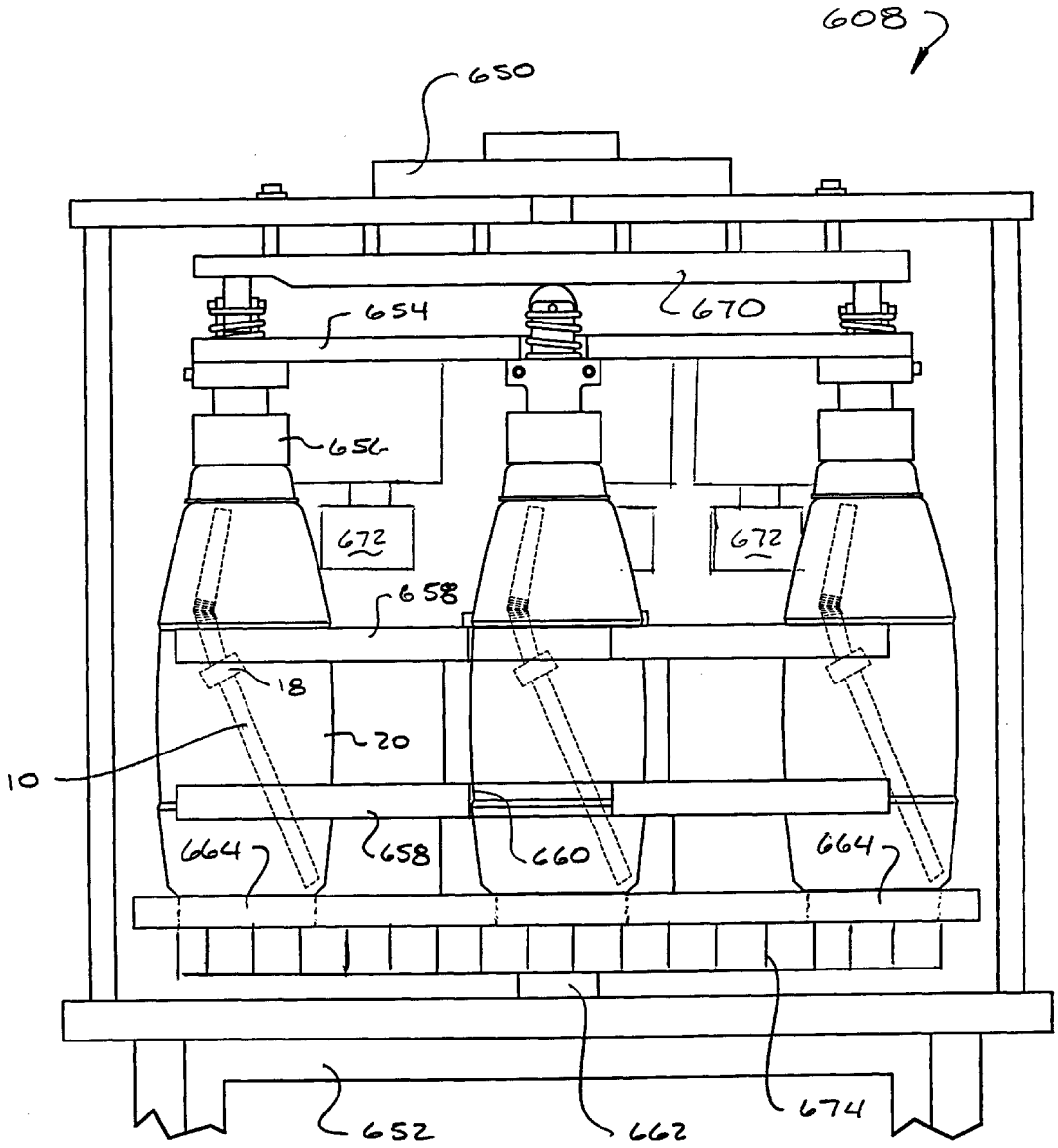
FIG. 20 is a side view of a straw release mechanism in accordance with another embodiment of the present invention.
Figure 20A:
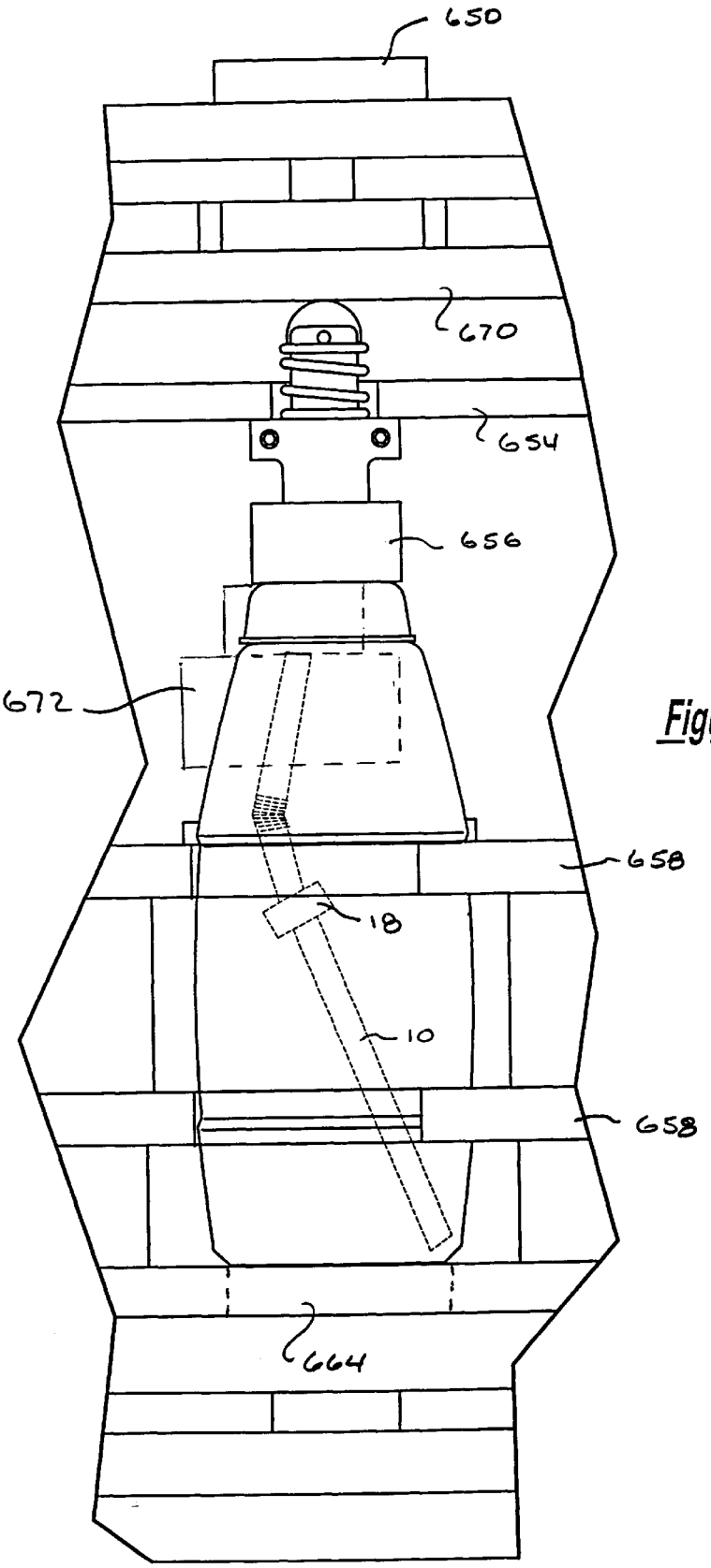
FIG. 20A is an enlargement of one container shown in FIG. 20.

Referring now to FIGS. 20–20A, a releasing device 608 in accordance with another embodiment of the present invention is illustrated. Releasing device 608 is designed to be an option to or a replacement for releasing device 508. Releasing device 608 includes a turret 650 rotatably disposed on a support structure 652. Turret 650 rotates with respect to support structure 652 in order to take each container 20 through a releasing mechanism which releases straw 10 from its armed position from mechanism 90.

Turret 650 includes an upper support plate 654 having a plurality of rotatable and axially movable backing heads 656; a pair of container receiving plates 658, each having a plurality of pockets 660; and a lower support plate 662 having a plurality of rotatable support bases 664. Heads 656, pockets 660 and bases 664 are each in registry with each other such that an individual container 20 is received within each set if heads 656, pockets 660 and bases 664. As each container 20 is fed to release device 608, turret 650 receives container 20 in one set of pockets 660 with container 20 sitting on base 664 spaced from head 656. As turret 650 rotates, a cam 670 positioned above heads 656 moves head 656 downward such that head 656 engages container 20. Simultaneous to the lowering of head 656, a rotatable wheel 672 is rotated into engagement with container 20. Each base 664 is rotated by engagement with a drive chain 674 such that each base 664 rotates on its axis as lower support plate 662 of turret 650 rotates on its axis. Engagement with wheel 672 compresses the side wall of container 20 to push straw 10 out of its armed position. The size of turret 650 is designed to cause approximately two revolutions of container 20 thereby ensuring the release of straw 10. Similar to mechanism 508, one of the reasons for securing container between heads 656 and bases 654 by the movement of heads 656 is to ensure that the compression of container 20 does not cause internal pressure within container 20 or sufficient distortion of container 20 which, in turn, could unseat the cap which seals container 20 after sealing. Continued rotation of turret 650 causes cam 670 to allow the spring loaded heads 656 to separate from container 20 and finally container 20 is fed back onto supply line 540 the same as that described above for device 508.

Figure 21:
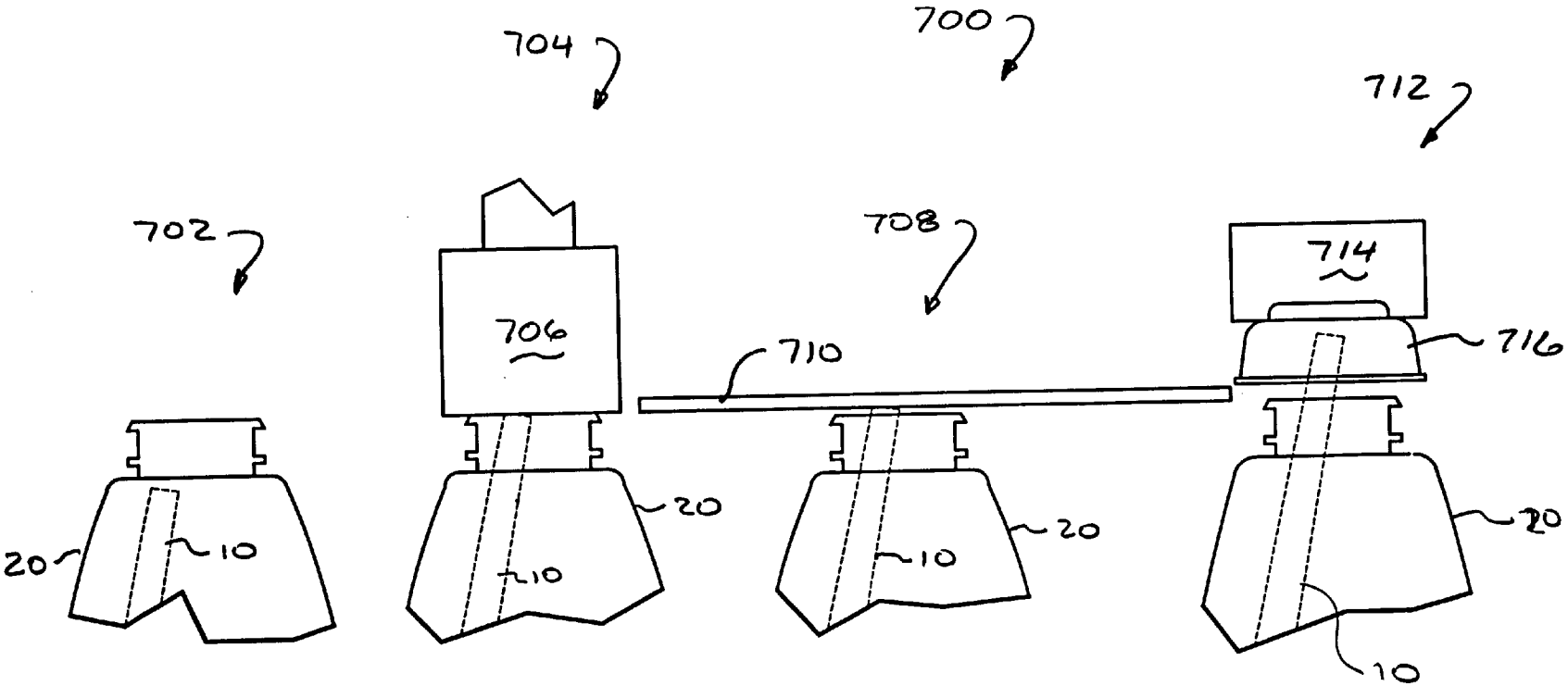
FIG. 21 is a schematic representation of a straw retention system in accordance with another embodiment of the present invention.

FIG. 21 is a schematic presentation of a system which eliminates the need for arming and releasing straw 10 within container 20. The purpose for arming straw 10 is to allow filling of container 20 without concern that straw 10 will float out through the opening in container 20 due to the buoyancy of straw 10 and lifter 18. Once the armed straw 10 and container 20 have been filled, releasing of straw 10 for the convenience of the consumer is required. The system illustrated in FIG. 21 eliminates the need for arming and releasing straw 10.

Assuming that straw 10 is placed loosely within container 20, straw 10 will remain within an upright container 20 until it is filled with the appropriate liquid. Once filled and capped, the cap retains straw 10 within container 20 with the buoyancy of straw 10 urging straw 10 against the cap. Thus, the only time that retention of straw 10 is required is between the filling and the capping operations.

FIG. 21 illustrates four positions along a filling and capping system 700 A first position 702 is when container 20 and straw 10 are first introduced into system 700. Straw 10 is resting against the bottom of container 20 because there is no liquid within container 20. A second position 704 is when a filling head 706 engages the opening of container 20. Filling head 706 is designed to supply the liquid to container 20, allow for the escape of air from container 20 and prevent straw 10 from extending an excessive amount out of the opening in container 20. As filling head 706 fills container 20, the buoyancy of straw 10 will urge straw 10 into engagement with head 706. A third position 708 is when filling head 706 has been removed from container 20 and prior to the capping of container 20. In this position, open top 26 is left open between the filling and capping operations. A retention plate 710 is positioned above container 20 to retain straw 10 within container 20 between filling and capping. Plate 710 is positioned a specified distance above containers 20 and the buoyancy of straws 10 urge straws 10 against plate 710. A fourth position 712 is when a capping head 714 places and seals a cap 716 onto container 20. Straws 10 go from being retained by plate 710 to being retained by cap 716. Once cap 716 is secured to container 20, container 20 is ready for shipment to the consumer with straw 10 and lifter 18 inside.

Plate 710 is designed to be adjacent to filling head 706 and adjacent to cap 716 such that straw 10 makes a smooth transition from head 706 to plate 710 and from plate 710 to cap 716. Typically filling and capping system 700 comprises a rotary filling machine and a separate rotatory capping machine. In this case, plate 710 would extend between the machines. Some filling and capping systems utilize a single rotatory filling and capping machine. In this case, plate 710 would extend between the end of the filling stations and the start of the capping stations.

While the above detailed description describes the preferred embodiment of the present invention, it should be understood that the present invention is susceptible to modification, variation and alteration without deviating from the scope and fair meaning of the subjoined claims.

What is claimed is:

1. A method of positioning one buoyant straw of a plurality of buoyant straws into each of a plurality of containers, said method comprising:

providing said plurality of containers in a first specified pattern;

providing said plurality of buoyant straws in a second specified pattern;

aligning said one buoyant straw of said plurality of buoyant straws with an opening in one of said plurality of containers;

inserting said one buoyant straw of said plurality of buoyant straws through said opening and into said one container;

filing said one container with a liquid;

capping said one container; and maintaining said one buoyant straw within said one container after said inserting step, after said filling step and immediately prior to said capping step by resisting a buoyant load of said one buoyant straw within said liquid by mechanically engaging said one buoyant straw.

2. A method of positioning one buoyant straw of a plurality of buoyant straws into each of a plurality of containers, said method comprising:

providing said plurality of containers in a first specified pattern;

aligning said one buoyant straw of said plurality of straws within an opening in one of said plurality of containers;

inserting said one buoyant straw of said plurality of buoyant straws through said opening and into said one container;

filling said one container after inserting said one buoyant straw;

maintaining said one buoyant straw within said one container after said inserting step and said filling step by mechanically engaging said one buoyant straw;

capping said one container after retaining said one buoyant straw.

3. A method of positioning one buoyant straw of a plurality of buoyant straws into each of a plurality of containers, said method comprising:

providing said plurality of containers in a first specified pattern;

providing said plurality of buoyant straws in a second specified pattern;

aligning said one buoyant straw of said plurality of buoyant straws with an opening in one of said plurality of containers;

inserting said one buoyant straw of said plurality of buoyant straws through said opening and into said one container;

maintaining said one buoyant straw within said one container after inserting said one buoyant straw to retain said one buoyant straw within said one container by mechanically engaging said one buoyant straw; and capping said one container.

4. A method of positioning one buoyant straw of a plurality of buoyant straws into each of a plurality of containers, said method comprising:

providing said plurality of containers in a first specified pattern;

providing said plurality of buoyant straws in a second specified pattern;

aligning said one buoyant straw of said plurality of buoyant straws with an opening in one of said plurality of containers;

using a first mechanism to insert said one buoyant straw of said plurality of buoyant straws through said opening and into said one container;

filling said one container;

capping said one container; and using a second mechanism to maintain said one buoyant straw within said one container after said using a first mechanism to insert said one buoyant straw and after said filling step and immediately prior to said capping step by mechanically engaging said one buoyant straw, said second mechanism being separate from said first mechanism.

* * * * *